US011786792B2

(12) United States Patent
Filippini

(10) Patent No.: US 11,786,792 B2
(45) Date of Patent: Oct. 17, 2023

(54) TABLE TENNIS APPARATUS AND METHODS

(71) Applicant: Pepper Pong, LLC, Denver, CO (US)

(72) Inventor: Thomas W. Filippini, Denver, CO (US)

(73) Assignee: PLAY EVERYWHERE SPORTS, LLC, Denver, CO (US)

( * ) Notice: Subject to any disclaimer, the term of this patent is extended or adjusted under 35 U.S.C. 154(b) by 0 days.

(21) Appl. No.: 18/108,397

(22) Filed: Feb. 10, 2023

(65) Prior Publication Data

US 2023/0271071 A1 Aug. 31, 2023

Related U.S. Application Data

(60) Provisional application No. 63/314,380, filed on Feb. 26, 2022.

(51) Int. Cl.

| | |
|---|---|
| ***A63B 67/04*** | (2006.01) |
| ***A63B 59/40*** | (2015.01) |
| ***A63B 71/00*** | (2006.01) |
| *A63B 102/16* | (2015.01) |

(52) U.S. Cl.

CPC ..... *A63B 67/04* (2013.01); *A63B 59/40* (2015.10); *A63B 71/0036* (2013.01); *A63B 2102/16* (2015.10)

(58) Field of Classification Search

CPC ..... A63B 67/04; A63B 67/045; A63B 59/40; A63B 61/00; A63B 61/003; A63B 71/0036; A63B 2102/16; E04H 17/1602; F16B 2001/0035

See application file for complete search history.

(56) References Cited

U.S. PATENT DOCUMENTS

| | | | | |
|---|---|---|---|---|
| 702,154 A * | 6/1902 | Quiggin et al. | ..... | A63B 67/045 473/491 |
| 3,879,035 A * | 4/1975 | Danchulis | ..... | A63B 59/40 473/527 |
| 6,676,113 B2 * | 1/2004 | Christensen | ..... | E01F 13/022 256/25 |

(Continued)

FOREIGN PATENT DOCUMENTS

| | | |
|---|---|---|
| CN | 200998575 | 1/2008 |
| CN | 203436784 U | 2/2014 |

(Continued)

OTHER PUBLICATIONS

Lodziak, "What are the best competition table tennis balls?", Jan. 3, 2019, tabletenniscoach.me.uk/table-tennis-equipment/10-best-competition-table-tennis-balls/ (Year: 2019).*

*Primary Examiner* — Joshua T Kennedy

(74) *Attorney, Agent, or Firm* — Stephen B. Katsaros; Patent Engineering, LLC

(57) ABSTRACT

A collapsible net for a game play is disclosed. The collapsible net includes a plurality of net-modules, each of the plurality of net-modules including a first-type coupler adjoining a left-side edge and a second-type coupler adjoining a right-side edge of each of the plurality of net-modules. The first-type coupler is configured to engage with the second-type coupler to couple the net-modules with one another, to thereby define an expanded length of the collapsible net.

21 Claims, 30 Drawing Sheets

(56) References Cited

U.S. PATENT DOCUMENTS

| | | | | |
|---|---|---|---|---|
| 7,429,223 | B2 | 9/2008 | Dovrat et al. | |
| 10,683,624 | B2 * | 6/2020 | Whiteley | E01F 13/022 |
| 2003/0153412 | A1 | 8/2003 | Duba et al. | |
| 2003/0197165 | A1 * | 10/2003 | Perelli | E01F 13/02 256/26 |
| 2014/0187360 | A1 | 7/2014 | Sberno | |
| 2016/0303446 | A1 | 10/2016 | Free | |
| 2017/0338017 | A1 * | 11/2017 | Fukushima | E05D 1/06 |

FOREIGN PATENT DOCUMENTS

| | | | | |
|---|---|---|---|---|
| CN | 205055358 | U | * | 3/2016 |
| CN | 208097298 | U | * | 11/2018 |
| CN | 212308823 | U | | 1/2021 |
| CN | 216571457 | U | * | 5/2022 |
| CN | 216571457 | U | | 5/2022 |
| CN | 216653322 | U | | 6/2022 |
| CN | 114949804 | A | | 8/2022 |
| KR | 20040052990 | A | * | 6/2004 |
| KR | 20060090132 | A | * | 8/2006 |
| KR | 100890352 | B1 | | 3/2009 |
| KR | 20100048812 | A | | 5/2010 |
| KR | 100995493 | B1 | | 11/2010 |
| KR | 20120125834 | A | * | 11/2012 |
| KR | 20190020556 | A | * | 3/2019 |
| KR | 20210109419 | A | * | 9/2021 |
| WO | 2017178800 | A1 | | 10/2017 |

* cited by examiner

TABLE TENNIS APPARATUS AND METHODS

CROSS REFERENCE TO RELATED APPLICATION

The present application claims priority to (i.e., is a non-provisional of) U.S. Provisional Patent Application No. 63/314,380 entitled "TABLE TENNIS APPARATUS AND METHODS", and filed 26 Feb. 2022 by Thomas W. Filippini.

A portion of the disclosure of this patent document contains material, which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

TECHNICAL FIELD

This disclosure relates in general to a game apparatus, but not by way of limitation, to a table tennis apparatus, a collapsible net for the table tennis game play, and ornamental appearance(s) of a collapsible net and/or paddle(s).

BACKGROUND

Table tennis is a recreational and professional sport in which two or four players hit a lightweight but rigid plastic ball back and forth across a table. It takes place on a hard table (or other suitable surface) divided by a linear net supported by edges of the table and tensioning the linear net. Players allow the rigid plastic ball to bounce once on their side of the table before returning the ball to the opposite side of the table. A point is scored when a player fails to return the ball.

SUMMARY

In some illustrative configurations, the techniques described herein relate to a collapsible net for a game play, the collapsible net including: a plurality of net-modules, each of the plurality of net-modules including: a left-side edge; a right-side edge oppositely disposed to the left-side edge, and defining a net-module width between the right-side edge and the left-side edge; a top edge perpendicularly disposed to the left-side edge and the right-side edge; a bottom edge oppositely disposed to the top edge; a first-type coupler adjoining the left-side edge of each of the plurality of net-modules; and a second-type coupler adjoining the right-side edge of each of the plurality of net-modules, the second-type coupler configured different from the first-type coupler; wherein the first-type coupler is configured to engage with the second-type coupler; wherein the plurality of net-modules are configurable between a play configuration and a stowed configuration, wherein: the play configuration includes: a first net-module of the plurality of net-modules; a second net-module of the plurality of net-modules; wherein the right-side edge of the first net-module is coupled to the left-side edge of the second net-module via the first-type coupler engaging with the second-type coupler, to define an expanded length of the collapsible net; and the stowed configuration includes: the right-side edge of the first net-module is adjacent to the left-side edge of the second net-module, and the left-side edge of the first net-module is adjacent to the right-side edge of the second net-module.

In some illustrative configurations, the techniques described herein relate to a collapsible net, wherein the play configuration includes: a combined length of the plurality of net-modules equal to a number of net-modules times the net-module width; wherein the expanded length of the collapsible net is the combined length of the plurality of net-modules.

In some illustrative configurations, the techniques described herein relate to a collapsible net, wherein in the play configuration: the expanded length is: less than a number of net-modules times the net-module width; and greater than the net-module width.

In some illustrative configurations, the techniques described herein relate to a collapsible net, wherein at least one of the first-type coupler and the second-type coupler is either a magnetic coupler or a mechanical coupler.

In some illustrative configurations, the techniques described herein relate to a collapsible net, and further including: wherein the first-type coupler includes: at least one first-type hinge; and wherein the second-type coupler includes: at least one second-type hinge configured to rotate relative to the at least one first-type hinge.

In some illustrative configurations, the techniques described herein relate to a collapsible net, and further including: wherein the first-type coupler includes: a pin protrusion adjoining at least a portion of the left-side edge of each of the plurality of net-modules; wherein the second-type coupler includes: a receptacle adjoining at least a portion of the right-side edge of each of the plurality of net-modules; and wherein the receptacle is configured to rotatably engage the pin protrusion, to thereby couple the left-side edge of the first net-module with the right-side edge of the second net-module.

In some illustrative configurations, the techniques described herein relate to a collapsible net, wherein the first-type coupler includes: a first magnet including: a first polarity side; and a second polarity side attracted to the first polarity side; wherein the first magnet is adjoining the left-side edge of each of the plurality of net-modules, with one of the first polarity side and the second polarity side exposed from the left-side edge of each of the plurality of net-modules; and wherein the second-type coupler includes: an iron section, or a second magnet including: a first polarity side; and a second polarity side; wherein the second magnet is adjoining the right-side edge of each of the plurality of net-modules, with the other of the first polarity side and the second polarity side exposed from the right-side edge of each of the plurality of net-modules; and wherein in the play configuration, the left-side edge of the first net-module is coupled with the right-side edge of the second net-module, via a magnetic force of attraction between: the first polarity side or the second polarity side of the first magnet and the second polarity side or first second polarity side of the second magnet, respectively; or the first polarity side or the second polarity side of the first magnet and the iron section of the second magnet.

In some illustrative configurations, the techniques described herein relate to a collapsible net, wherein each of the plurality of net-modules includes: a rigid panel; and a rectangular profile.

In some illustrative configurations, the techniques described herein relate to a collapsible net, wherein each of the plurality of net-modules includes: a plurality of openings formed in the rectangular profile.

In some illustrative configurations, the techniques described herein relate to a collapsible net, wherein each of the plurality of net-modules includes: a collapsible stand including: a foot; and a stem attached to the foot; wherein the collapsible stand is rotatably coupled with each of the plurality of net-modules, via the stem; wherein the collapsible stand is configurable between an open configuration and a closed configuration, wherein in the open configuration, the foot is oriented perpendicular to a plane defined by each of the plurality of net-modules; and wherein in the closed configuration, the foot is oriented parallel to the plane defined by each of the plurality of net-modules.

In some illustrative configurations, the techniques described herein relate to a collapsible net, wherein each of the plurality of net-modules further includes: a groove formed on the bottom edge; wherein in the closed configuration, the foot is oriented positioned within the groove.

In some illustrative configurations, the techniques described herein relate to a collapsible net for a game play, the collapsible net including: a plurality of net-modules, each of the plurality of net-modules including: a left-side edge; a right-side edge oppositely disposed to the left-side edge; a top edge; and a bottom edge oppositely disposed to the left-side edge; a first-type coupler adjoining the left-side edge of each of the plurality of net-modules; and a second-type coupler adjoining the right-side edge of each of the plurality of net-modules, wherein the second-type coupler is engaged with the first-type coupler; wherein net-modules of each pair of net-modules of the plurality of net-modules are rotatably coupled with each other, via the first-type coupler and the second-type coupler; wherein the plurality of net-modules are configurable between a play configuration and a stowed configuration; wherein in the play configuration, each of the plurality of net-modules is positioned away from an adjacent net-module, to define an expanded length of the collapsible net; and wherein in the stowed configuration, each of the plurality of net-modules is positioned facing an adjacent net-module, to thereby define a collapsed length of the collapsible net.

In some illustrative configurations, the techniques described herein relate to a collapsible net, wherein the first-type coupler includes: at least one first-type hinge; wherein the second-type coupler includes: at least one second-type hinge: wherein the at least one first-type hinge is engaged with the at least one second-type hinge, and wherein the at least one first-type hinge is vertically offset from the at least one second-type hinge.

In some illustrative configurations, the techniques described herein relate to a collapsible net, wherein each of the plurality of net-modules includes: a frame defining a periphery including: the left-side edge; the right-side edge oppositely disposed to the left-side edge; the top edge; and the bottom edge oppositely disposed to the top edge; and a mesh adjoining at least two of the left-side edge, the right-side edge, the top edge, and the bottom edge, within the periphery defined by the frame.

In some illustrative configurations, the techniques described herein relate to a collapsible net, wherein each of the plurality of net-modules includes: a collapsible stand including: a foot; and a stem attached to the foot; wherein the collapsible stand is rotatably coupled with each of the plurality of net-modules, via the stem; wherein the collapsible stand is configurable between an open configuration and a closed configuration, wherein in the open configuration, the foot is oriented perpendicular to a plane defined by each of the plurality of net-modules; and wherein in the closed configuration, the foot is oriented parallel to the plane defined by each of the plurality of net-modules.

In some illustrative configurations, the techniques described herein relate to a collapsible net, wherein each of the plurality of net-modules further includes: a groove formed on the bottom edge; wherein in the closed configuration, the foot is oriented positioned within the groove.

In some illustrative configurations, the techniques described herein relate to a collapsible net for a game play, the collapsible net including: a plurality of protrusion-based net-modules, each of the plurality of protrusion-based net-modules including: a left-side edge; a right-side edge oppositely disposed to the left-side edge, and defining a net-module width between the right-side edge and the left-side edge; a top edge; a bottom edge oppositely disposed to the top edge; a first-type coupler adjoining at least one of the left-side edge and the right-side edge of each of the plurality of protrusion-based net-modules; wherein the first-type coupler includes: a pin protrusion adjoining at least a portion of the left-side edge of each of the plurality of protrusion-based net-modules; a plurality of receptacle-based net-modules, each of the plurality of receptacle-based net-modules including: a left-side edge; a right-side edge oppositely disposed to the left-side edge, and defining a net-module width between the right-side edge and the left-side edge; a top edge; a bottom edge oppositely disposed to the top edge; a second-type coupler adjoining at least one of the left-side edge and the right-side edge of each of the plurality of receptacle-based net-modules; wherein the second-type coupler includes: a receptacle adjoining at least a portion of each of the left-side edge and the right-side edge of each of the plurality of receptacle-based net-modules; and wherein the receptacle is configured to rotatably engage the pin protrusion, to thereby couple a receptacle-based net-module with a protrusion-based net-module.

In some illustrative configurations, the techniques described herein relate to a collapsible net, wherein the plurality of receptacle-based net-modules and the plurality of protrusion-based net-modules are configurable between a play configuration and a stowed configuration; wherein in the play configuration, each of the plurality of receptacle-based net-modules and the plurality of protrusion-based net-modules is positioned away from an adjacent net-module, to define an expanded length of the collapsible net; and wherein in the stowed configuration, each of the plurality of receptacle-based net-modules and the plurality of protrusion-based net-modules is positioned facing an adjacent net-module, to thereby define a collapsed length of the collapsible net.

In some illustrative configurations, the techniques described herein relate to a collapsible net, wherein the first-type coupler adjoining the left-side edge is facing opposite to the first-type coupler adjoining the right-side edge of each of the plurality of protrusion-based net-modules; and wherein the second-type coupler adjoining the left-side edge is facing opposite to the second-type coupler adjoining the right-side edge of each of the plurality of receptacle-based net-modules.

In some illustrative configurations, the techniques described herein relate to a game apparatus including: at least a pair of paddles; a first ball including: a first predefined hardness; a second ball including: a second predefined hardness different from the first predefined hardness; and a collapsible net configured to be mounted over a surface, the collapsible net including: a plurality of net-modules, each of the plurality of net-modules including: a left-side edge; a right-side edge oppositely disposed to the left-side edge; a top edge; and a bottom edge oppositely disposed to the top edge; and a first-type coupler adjoining the left-side edge of each of the plurality of net-modules; and a second-type coupler adjoining the right-side edge of each of the plurality of net-modules, wherein the second-type coupler is couplable with the first-type coupler; wherein each of the plurality of net-modules is configured to couple with another of the plurality of net-modules, via one of the first-type coupler and the second-type coupler; wherein the plurality of net-modules are configurable between a play configuration and a stowed configuration; wherein in the play configuration, each of the plurality of net-modules is positioned away from an adjacent net-module, to define a expanded length of the collapsible net; and wherein in the stowed configuration, each of the plurality of net-modules is positioned facing an adjacent net-module, to thereby collapsed length of the collapsible net.

In some illustrative configurations, the techniques described herein relate to a game apparatus, wherein each of the pair of paddles includes: a flat panel including: a top surface; and a bottom surface; a first elastic panel attached to the top surface a second elastic panel attached to the bottom surface; and a handle attached to the flat panel.

In some illustrative configurations, the techniques described herein relate to a game apparatus, wherein the first elastic lining includes: a plurality of cut-outs adjoining the handle, the plurality of cut-outs configured to enable a grip.

In some illustrative configurations, the techniques described herein relate to a game apparatus, wherein the plurality of cut-outs are linear and oriented parallel to a central axis of the handle.

In some illustrative configurations, the techniques described herein relate to an ornamental appearance of a collapsible net as shown in FIGS. 34-40 configured in a narrow embodiment with elements/limitations that may be later removed.

In some illustrative configurations, the techniques described herein relate to an ornamental appearance of a paddle as shown in FIGS. 41-47 configured in a narrow embodiment with elements/limitations that may be later removed.

In some illustrative configurations, the techniques described herein relate to an ornamental appearance of a collapsible net as shown in FIGS. 48-54 configured in a narrow embodiment with elements/limitations that may be later removed.

In some illustrative configurations, the techniques described herein relate to an ornamental appearance of a single-coupler receptacle-based net-module as shown in FIGS. 55-61 configured in a narrow embodiment with elements/limitations that may be later removed.

In some illustrative configurations, the techniques described herein relate to an ornamental appearance of a single-coupler protrusion-based net-module as shown in FIGS. 62-68 configured in a narrow embodiment with elements/limitations that may be later removed

BRIEF DESCRIPTION OF THE DRAWING

The accompanying figures of the drawing, which are included to provide a further understanding of general aspects of the system/method, are incorporated in and constitute a part of this specification. These illustrative aspects of the system/method, and together with the detailed description, explain the principles of the system. No attempt is made to show structural details in more detail than is necessary for a fundamental understanding of the system and various ways in which it is practiced. The following figures of the drawing include.

Figure 1:
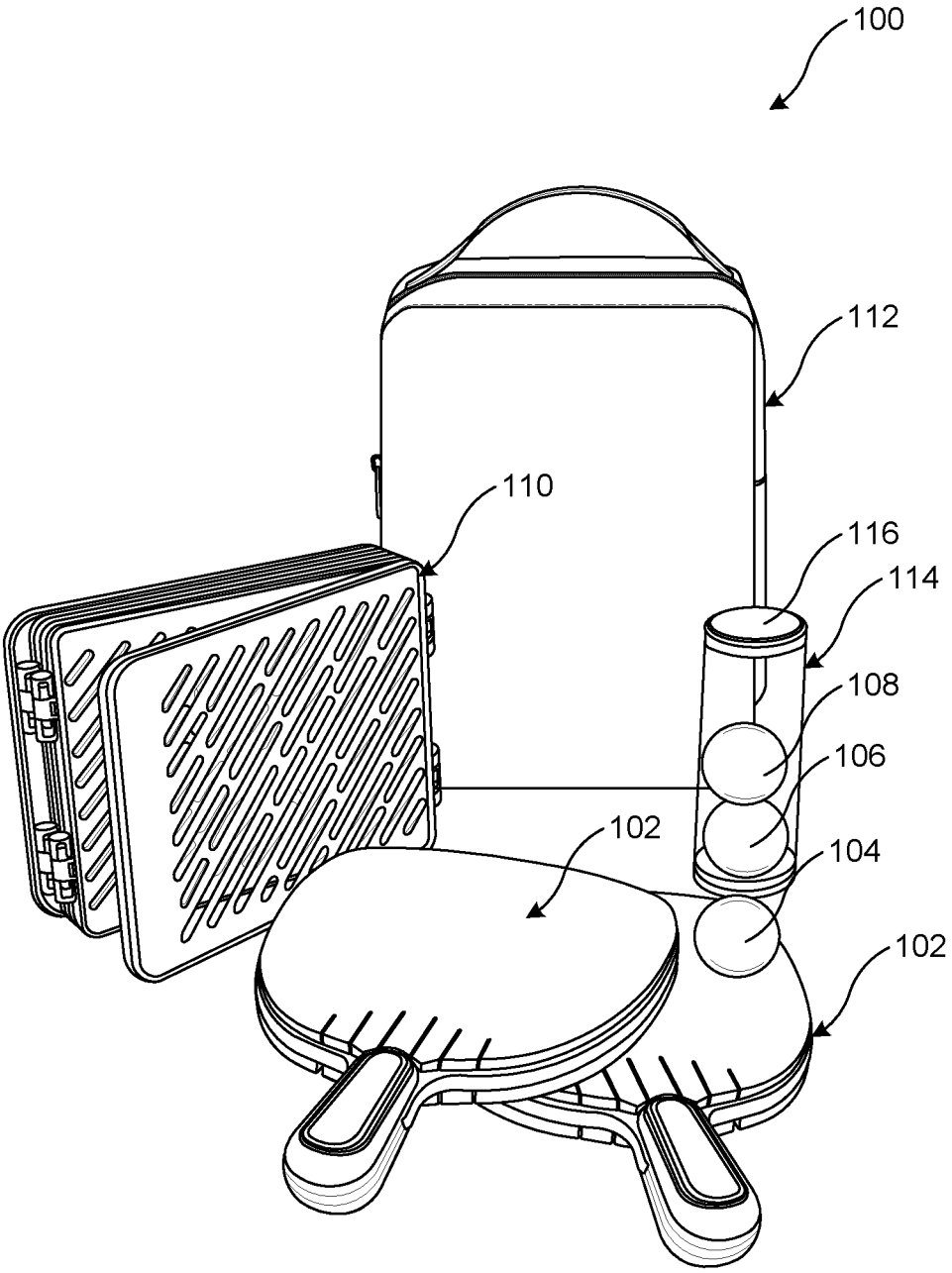
FIG. 1 illustrates a perspective view of an illustrative configuration game apparatus in an unpacked state and showing the components of the game apparatus.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered as illustrative only, with the true scope and spirit being indicated by the following claims.

An apparatus for game play is disclosed, that includes two or more paddles, a set of balls, and a collapsible net. Each of the balls and each of the paddles are configured for a muted or slowed gameplay relative to traditional table tennis. For example, each of the balls and each of the paddles include foam surfaces for the muted or slowed gameplay. The foam surfaces may have a hardness which is lower than the hardness of the paddles and ball of the traditional table tennis. Moreover, multiple balls having different hardness and hence a different bounce provides multiple options of the hardness of the game play.

The collapsible net is comprised of multiple net modules which can be folded and expanded to obtain a stowed configuration and a play configuration. The folding or collapsing of the collapsible net allows for easy portability for storage and travel. In some embodiments, it may be possible to couple and uncouple the modules with each other to create the net for the game play. As such, the modular nature of the collapsible net allows for creating a net of any desired length to cover a transverse length of the table or any surface (e.g. bonnet of an automobile) for the game play. For example, the net modules may be couplable to each other via magnetic or mechanical couplers. The magnetic couplers may allow attaching of the net modules simply by placing the modules in proximity to each other whereby the magnetic couplers cause the coupling between the net modules under the magnetic force of attraction. Alternately, hinge-based mechanical couplers are proposed in the below disclosure for coupling the net modules. Each of the net modules may be made from a single piece molded plastic with inherent reinforcement, which provides a durable, long-lasting, and lightweight solution to play on-the-go. Further, the net modules may be configured a rectangular profile which may also provide a display area where an interchangeable branding panel may be attached. This allows branding space to sponsors during competitive plays in public venues by companies and groups in a highly adaptable way.

Figure 2:
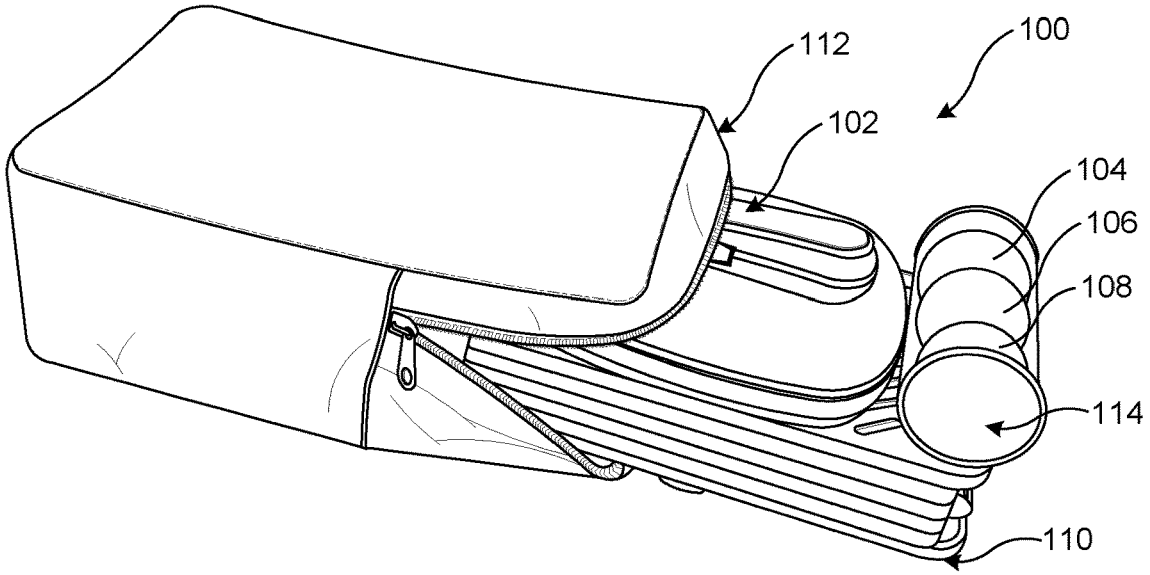
FIG. 2 illustrates another perspective view of the game apparatus of FIG. 1 in a semi-packed state.
Figure 3:
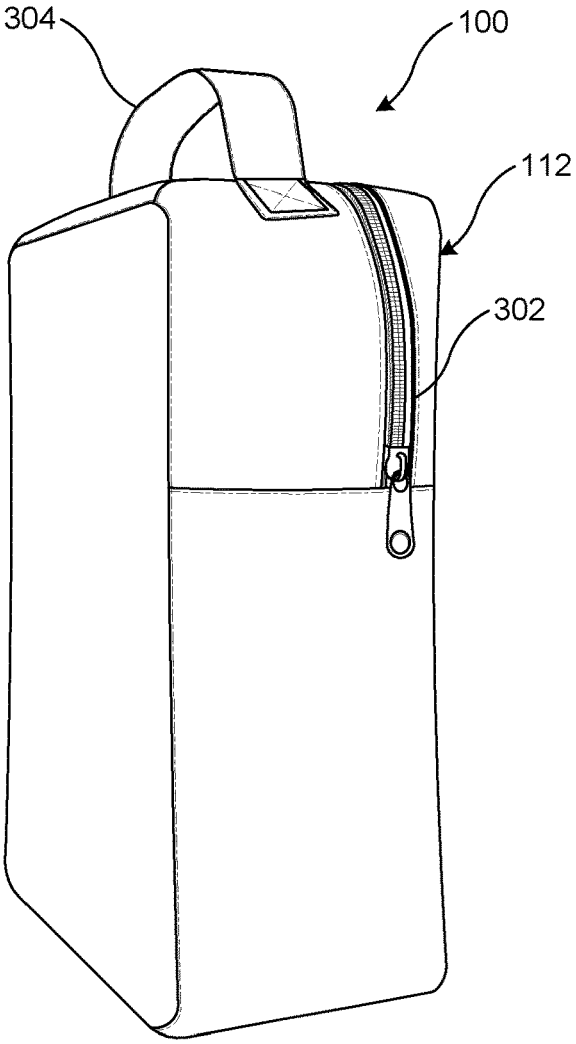
FIG. 3 illustrates yet another view of the game apparatus of FIG. 1 in a packed state.

FIG. 1 illustrates a perspective view of a game apparatus 100 in an unpacked state and showing the components of the game apparatus 100, in accordance with some configurations of the present disclosure. FIG. 2 illustrates another perspective view of the game apparatus 100 in a semi-packed state. FIG. 3 illustrates yet another view of the game apparatus 100 in a packed state.

In some configurations, the game apparatus 100 may include at least a pair of paddles 102. For example, as shown in FIGS. 1-2, the game apparatus 100 may include two paddles 102, and as such may be suitable for a game play between two players. Further, two or more game apparatuses 100 may be combined to allow a game play between more than two players. It should be noted that, in alternate configurations, the game apparatus 100 may include four, six, or any other number of paddles, depending on the number of players. For example, each of the paddles 102 may be shaped and sized similar to a table-tennis racket. The paddles 102 are further explained in detail in conjunction with FIGS. 22-23.

The game apparatus 100 may further include one or more balls. Each of the one or more balls may have a different configuration, for example, in terms of hardness. For example, as shown in FIGS. 1-2, the game apparatus 100 may include three balls—a first ball 104, a second ball 106, and a third ball 108. The first ball 104 may have a first predefined hardness. Similarly, the second ball may have a second predefined hardness different from the first predefined hardness. And similarly, the third ball 108 may have a third predefined hardness different from the first predefined hardness and the second predefined hardness. The balls 104, 106, 108 are further explained in detail in conjunction with FIGS. 24-27.

The game apparatus 100, in some embodiments, may further include a ball-receptacle 114 which store the balls 104, 106, 108. For example, as shown in FIGS. 1-2, the ball-receptacle 114 may have a cylindrical elongated profile sized to receive and store the balls 104, 106, 108 one above the other. Further, the ball-receptacle 114 may include a cap 116 to secure the balls 104, 106, 108 within the ball-receptacle 114. In order to remove or more of the balls 104, 106, 108 from the ball-receptacle 114, the cap 116 may be dislodged from the ball-receptacle 114 to thereby access the balls 104, 106, 108.

The game apparatus 100 may further include a collapsible net 110 which may be configured to be mounted over a surface. For example, the surface may be a top of a table (e.g., a dining table, a work table, etc.), a bonnet or a roof of an automobile (e.g. a car), a top of a table tennis table, etc. The collapsible net 110 may be configurable between a stowed configuration (as shown in FIGS. 1-2) and a play configuration. In the stowed configuration, the collapsible net 110 may be compact which allows the collapsible net 110 to be packed in an apparatus bag 112. For the purpose of game play, the collapsible net 110 may be reconfigured in the play configuration, and then used as a net (for example, similar to the net of a table tennis game play). The collapsible net 110 may include a plurality of net-modules, such that in the stowed configuration, each of the plurality of net-modules may be positioned facing an adjacent net-module, to thereby define a collapsed length of the collapsible net 110. Further, in the play configuration, each of the plurality of net-modules may be positioned away from an adjacent net-module, to define an expanded length of the collapsible net 110.

The apparatus bag 112 may be configured to received and store the different components of the game apparatus 100, namely the paddles 102, the balls 104, 106, 108, and the collapsible net 110. The apparatus bag 112, in some example configurations, may be made from a fabric or a polymer or a composite material, such as cotton, nylon, polyester, etc. The apparatus bag 112, as shown in FIG. 3 may include a zip-lock 302 or any other closing mechanism for packing and securing the components of the game apparatus 100 within the apparatus bag 112. Packing and securing of the components within the apparatus bag 112 allows for easy portability of the game apparatus 100. Further, the apparatus bag 112 may include a handle 304 formed or attached to the body of the apparatus bag 112 to further assist a user in carrying and moving the apparatus bag 112. In order to use the game apparatus for the game play, the apparatus bag 112 may be opened by manually manipulating the zip-lock 302 and unpacking the above components of the game apparatus 100. The apparatus bag 112, therefore, may be used as a backpack or a carry bag for packing and transporting the apparatus 100.

Figure 4:
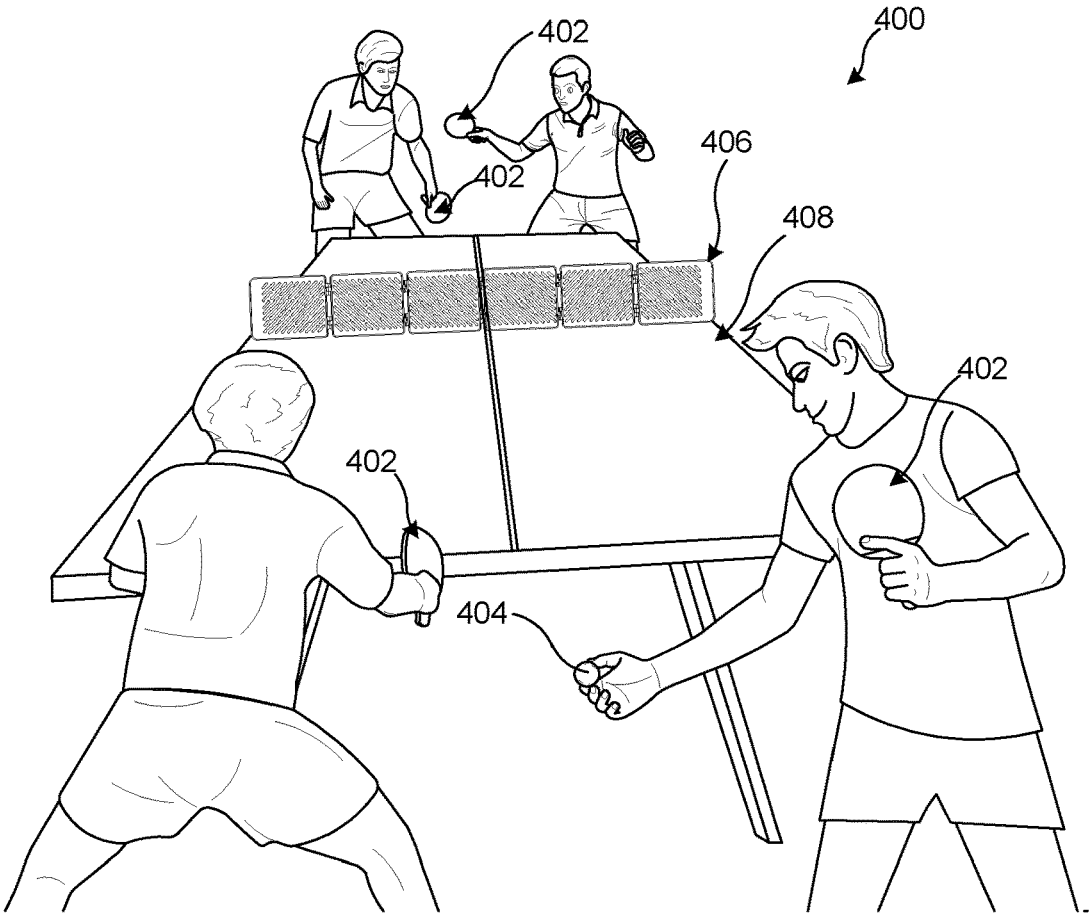
FIG. 4 illustrates an example scenario of a game play using the game apparatus of FIG. 1.

FIG. 4 illustrates an example scenario 400 of a game play using the game apparatus 100, in accordance with some configurations of the present disclosure. As can be seen in FIG. 4, the game apparatus 100 including four paddles 402 (corresponding to the paddles 102) may be used, for allowing four players to play. Alternately, two game apparatuses 100 with two paddles 402 each may be used to allow four players to play. In order to start the game play, a collapsible net 406 (corresponding to the collapsible net 110), which may be configured in the stowed configuration initially when packed in the apparatus bag 112, may be unpacked from the apparatus bag 112. Then, the collapsible net 406 may be configured in the play configuration and positioned on a surface 408. As mentioned above, the surface 408 may be a top of a table (e.g., a dining table, a work table, etc.), a bonnet or a roof of an automobile (e.g. a car), or a top of a table tennis table, etc. Further, a ball 404 (corresponding to one of the balls 104, 106, 108) may be used for the game play.

Figure 5:
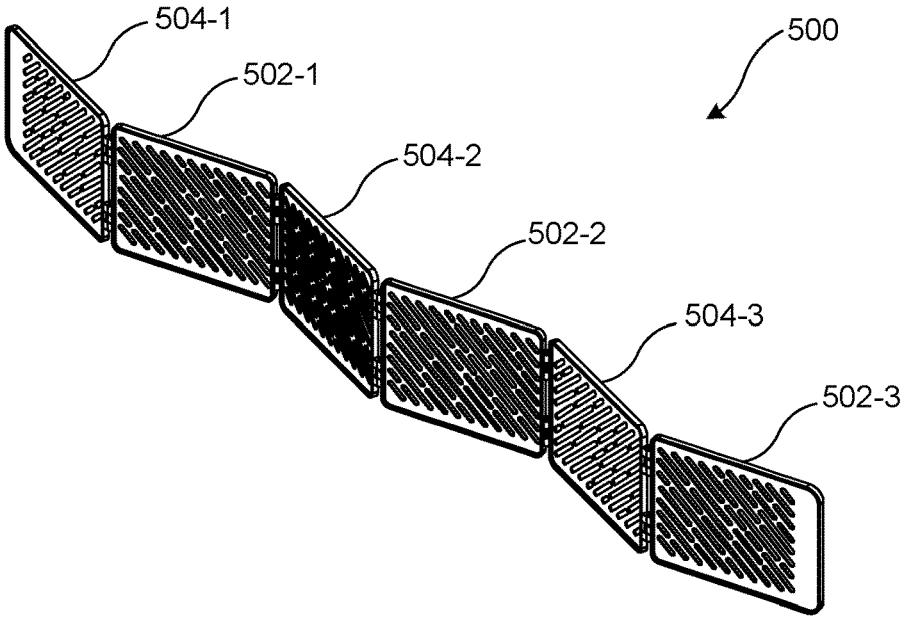
FIG. 5 illustrates a perspective view of an illustrative configuration of a collapsible net configured in play configuration.
Figure 6:
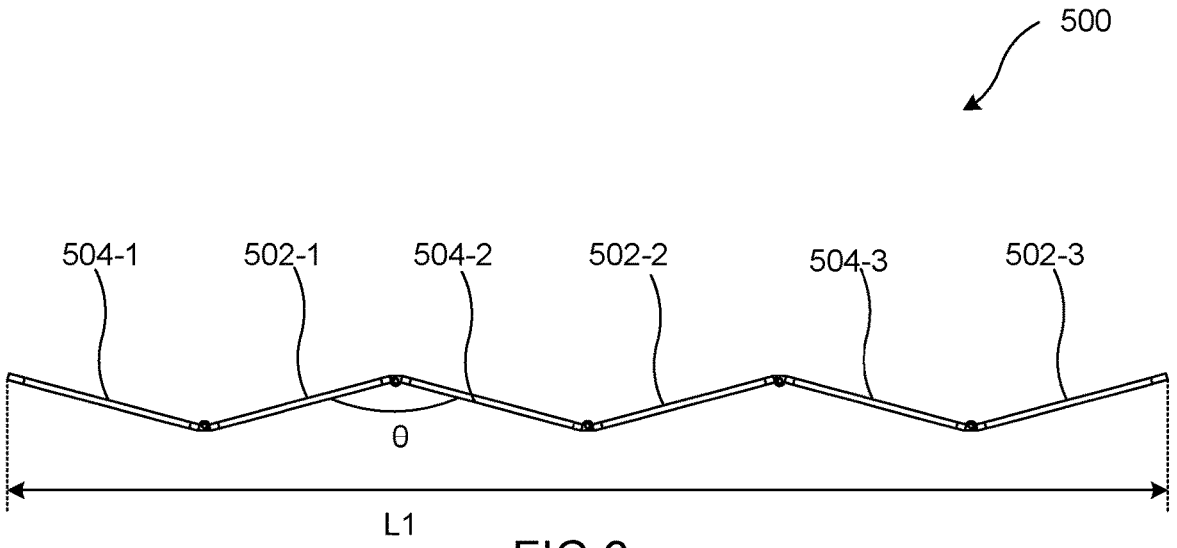
FIG. 6 illustrates a top view of the collapsible net of FIG. 5 configured in play configuration.
Figure 7:
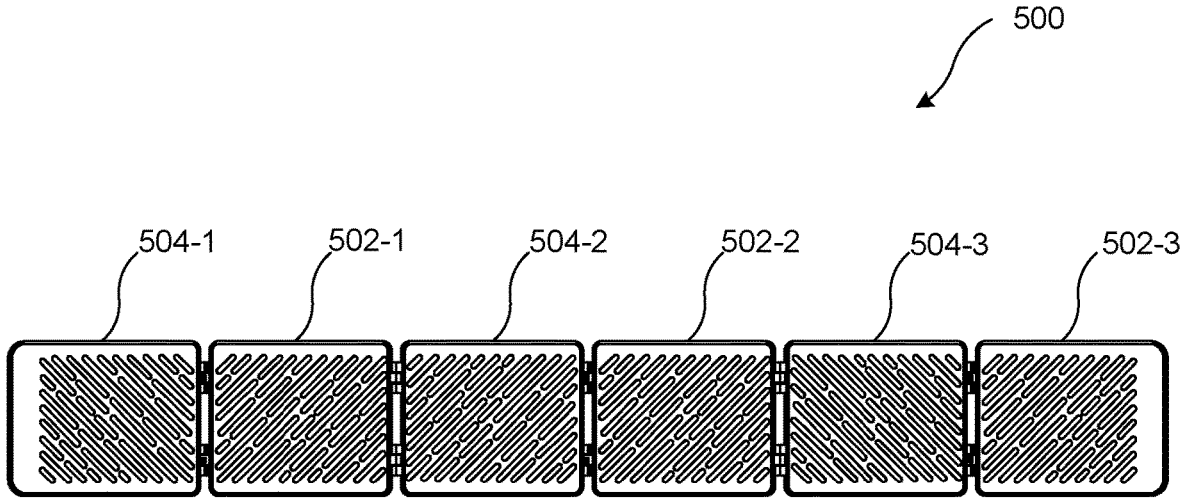
FIG. 7 illustrates a front view of the collapsible net of FIG. 5 configured in play configuration.

FIG. 5, FIG. 6, and FIG. 7 illustrate a perspective view, a top view, and a front view, respectively of a collapsible net 500 (corresponding to the collapsible net 110 and the collapsible net 406) configured in play configuration, in accordance with some illustrative configurations of the present disclosure.

The collapsible net 500 may include a plurality of protrusion-based net-modules 502-1, 502-2 (hereinafter, collectively or individually referred to as plurality of protrusion-based net-modules 502). In some embodiments, as shown in FIGS. 5-7, the collapsible net 500 may include three protrusion-based net-modules 502-1, 502-2, 502-3. However, in alternate embodiments, the collapsible net 500 may include any other number (more or less than three) of protrusion-based net-modules. Each of the plurality of protrusion-based net-modules 502 may include a first-type coupler. The first-type coupler may include a pin protrusion.

The collapsible net 500 may further include a plurality of receptacle-based net-modules 504-1, 504-2, 504-3 (hereinafter, collectively or individually referred to as plurality of receptacle-based net-modules 504). In some embodiments, as shown in FIGS. 5-7, the collapsible net 500 may include three receptacle-based net-modules 504-1, 504-2, 504-3. However, in alternate embodiments, the collapsible net 500 may include any other number (more or less than three) of receptacle-based net-modules. Each of the plurality of receptacle-based net-modules 504 may include a second-type coupler. The second-type coupler may include a receptacle. The receptacle may be configured to rotatably engage the pin protrusion, to thereby couple a receptacle-based net-module 504 with a protrusion-based net-module 502.

The plurality of receptacle-based net-modules 504 and the plurality of protrusion-based net-modules 502 may be configurable between a play configuration and a stowed configuration. In the play configuration, as shown in FIG. 5, each of the plurality of receptacle-based net-modules 504 and the plurality of protrusion-based net-modules 502 may be positioned away from an adjacent net-module, to define an expanded length of the net. In the stowed configuration, each of the plurality of receptacle-based net-modules 504 and the plurality of protrusion-based net-modules 502 may be positioned facing an adjacent net-module, to thereby define a collapsed length of the net.

It should be further noted that, as clearly shown in FIG. 6, in the play configuration, the plurality of receptacle-based net-modules 504 and the plurality of protrusion-based net-modules 502 may be positioned in a zig-zag fashion. The zig-zag positioning of the receptacle-based net-modules 504 and the protrusion-based net-modules 502 allows the collapsible net 500 to be positioned on a flat surface (e.g. the surface 408) in the play configuration. Therefore, the collapsible net doesn't require any external support means for erecting the collapsible net 500 on a surface when in the play configuration.

As will be understood, due to the zig-zag positioning, expanded length L1 of the collapsible net 500 (in the play configuration) may be less than a number of net-modules (i.e. combination of the plurality of receptacle-based net-modules 504 and the plurality of protrusion-based net-modules 502) times the net-module width. Further, the expanded length L1 of the collapsible net 500, in the play configuration, may be greater than the width of an individual receptacle-based net-module 504 or a protrusion-based net-module 502.

In some embodiments, the first-type coupler and the second-type coupler may allow the adjacent receptacle-based net-module 504 and the protrusion-based net-module 502 to rotate through at least 180 degrees. In some alternate embodiments, the first-type coupler and the second-type coupler may allow the adjacent receptacle-based net-module 504 and the protrusion-based net-module 502 to rotate through a predetermined angle θ which is less than 180 degrees, for example, until 170 degrees. In other words, in such embodiments, the first-type coupler and the second-type coupler may prevent the adjacent receptacle-based net-module 504 and the protrusion-based net-module 502 to rotate beyond a predetermined angle (e.g. 170 degrees), to cause the receptacle-based net-modules 504 and the protrusion-based net-modules 502 to be positioned in zig-zag fashion. To this end, by way of an example, the first-type coupler and the second-type coupler may be provided with stoppers that prevent the adjacent receptacle-based net-module 504 and the protrusion-based net-module 502 from rotate beyond the predetermined angle.

Figure 8:
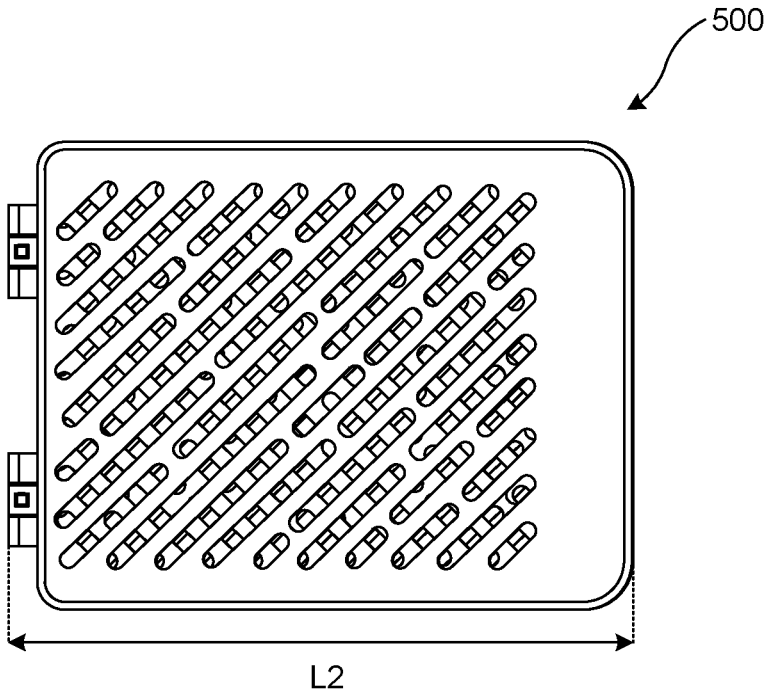
FIG. 8 illustrates a front view of the collapsible net of FIG. 5 configured in the stowed configuration.
Figure 9:
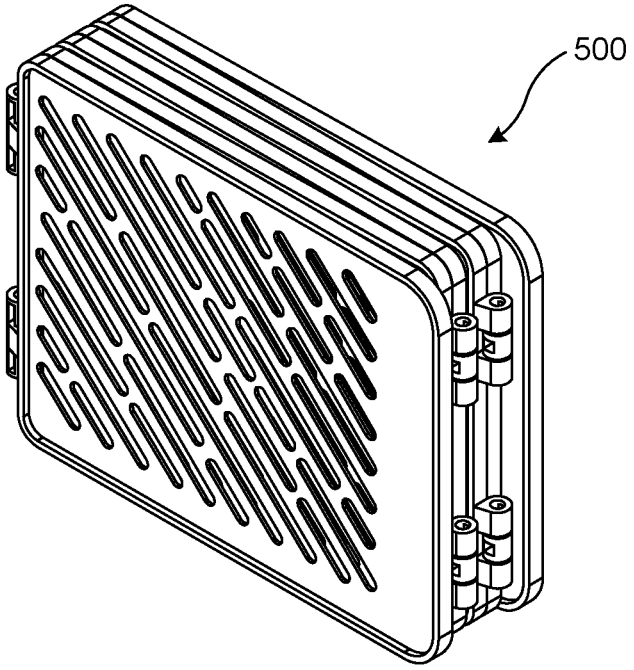
FIG. 9 illustrate a perspective view of the collapsible net of FIG. 5 configured in the stowed configuration.

FIG. 8 and FIG. 9 illustrate a front view and a perspective view, respectively of the collapsible net 500 configured in the stowed configuration;

As mentioned above, the plurality of receptacle-based net-modules 504 and the plurality of protrusion-based net-modules 502 may be configurable between the play configuration and the stowed configuration. In the stowed configuration, the right-side edge of the first net-module may be positioned adjacent to the left-side edge of the second net-module, and the left-side edge of the first net-module is adjacent to the right-side edge of the second net-module. As such, in the stowed configuration, each of the plurality of receptacle-based net-modules 504 and the plurality of protrusion-based net-modules 502 may be positioned facing an adjacent net-module, to thereby define a collapsed length L2 of the collapsible net 500. In other words, in the stowed configuration, the protrusion-based net-module 502-1 may be sandwiched between the receptacle-based net-module 501-1 and the receptacle-based net-module 501-2. Similarly, the receptacle-based net-module 501-1 may be sandwiched between the protrusion-based net-module 502-1 and the protrusion-based net-module 502-2, and so on. As such, in the stowed configuration, the plurality of receptacle-based net-modules 504 and the plurality of protrusion-based net-modules 502 may be stacked against each other.

As a result, a collapsed length L2 of the collapsible net 500 (in the stowed configuration) may be equal to the width of an individual receptacle-based net-module 504 or the protrusion-based net-module 502. The collapsibility of the net 500 makes the net compact and allows for easy packing and portability, for example during traveling.

In some embodiments, the plurality of receptacle-based net-modules 504 may include one or more single-coupler receptacle-based net-modules and one or more double-coupler receptacle-based net-modules. Similarly, the plurality of protrusion-based net-modules 502 may include one or more single-coupler protrusion-based net-modules and one or more double-coupler protrusion-based net-modules. The protrusion-based net-modules 502 are further explained in detail in conjunction with FIGS. 10-15. The receptacle-based net-modules 504 are further explained in detail in conjunction with FIGS. 16-21.

Figure 10:
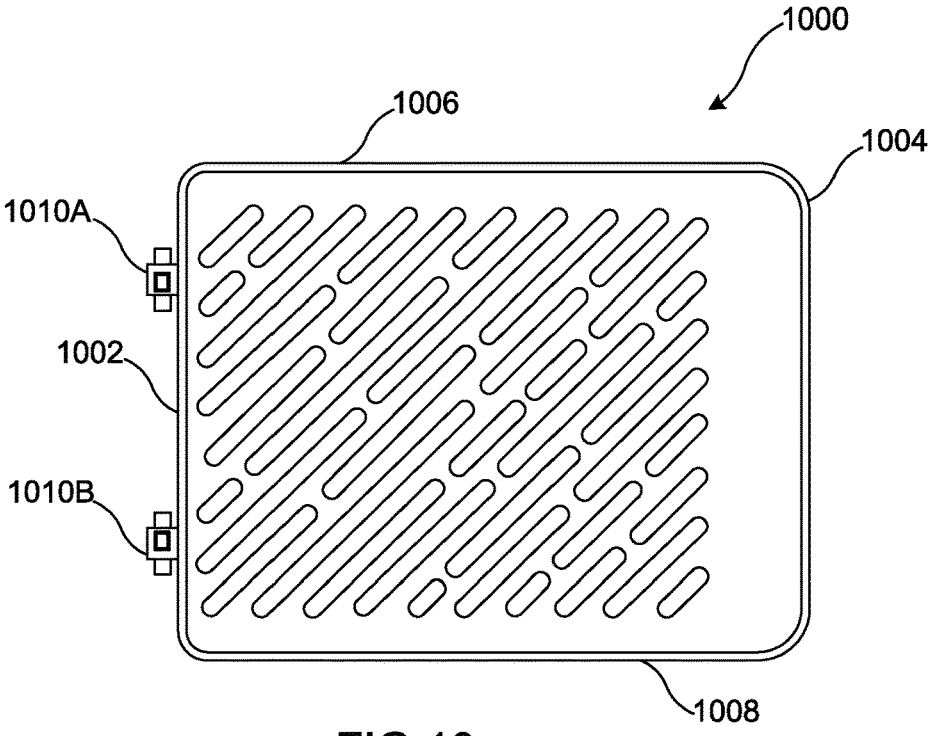
FIG. 10 illustrates a front view of a single-coupler protrusion-based net-module.
Figure 11:
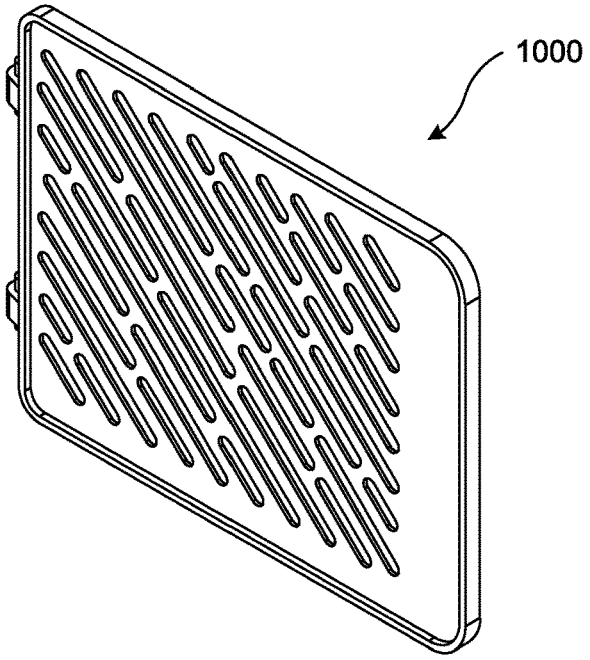
FIG. 11 illustrates a perspective view of the single-coupler protrusion-based net-module of FIG. 10.
Figure 12:
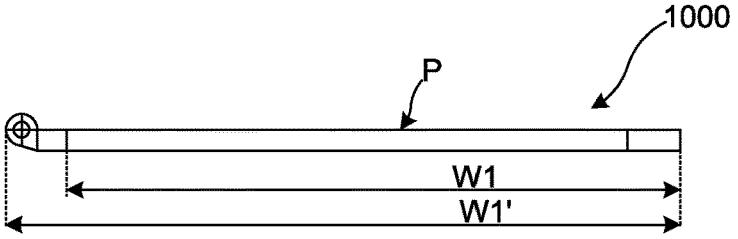
FIG. 12 illustrates a top view of the single-coupler protrusion-based net-module of FIG. 10.

FIG. 10, FIG. 11, and FIG. 12 illustrate a front view, a perspective view, and a top view, respectively, of a single-coupler protrusion-based net-module 1000 (corresponding to the protrusion-based net-module 502), in accordance with some configurations of the present disclosure.

The single-coupler protrusion-based net-module 1000 may include a left-side edge 1002, a right-side edge 1004 oppositely disposed to the left-side edge 1002. The single-coupler protrusion-based net-module 1000 may further include a top edge 1006 and a bottom edge 1008 oppositely disposed to the top edge 1006. The single-coupler protrusion-based net-module 1000 may further include a first-type coupler 1010 adjoining one of the left-side edge 1002 and the right-side edge 1004. For example, in some embodiments, as shown in FIGS. 10-12, the single-coupler protrusion-based net-module 1000 may include the first-type coupler 1010 adjoining the left-side edge 1002. As will be appreciated, in alternate embodiments, the first-type coupler 1010 could be adjoining the right-side edge 1004.

As shown in FIGS. 10-11, in some embodiments, the single-coupler protrusion-based net-module 1000 may include two first-type couplers 1010A, 1010B on the left-side edge 1002. The two first-type couplers 1010A, 1010B (also collectively referred to as first-type couplers 1010 in this disclosure) may be spaced apart by a predefined distance. It should be noted that in alternate embodiments, the single-coupler protrusion-based net-module 1000 may include any other number (i.e. more or less than two) of the first-type couplers 1010.

As shown in FIG. 12, the left-side edge 1002 and the right-side edge 1004 define a net-module width W1 therebetween, exclusive of the first-type couplers 1010). The left-side edge 1002 and the right-side edge 1004 may define a net-module width W1' therebetween, inclusive of the first-type couplers 101.

The first-type coupler 1010 may be configured as at least one first-type hinge including a pin protrusion adjoining at least a portion of the left-side edge 1002 of the single-coupler protrusion-based net-module 1000. Further, as shown in FIG. 10, the pin protrusion may include two protrusions emanating above and below, respectively of a middle body. Further, in some embodiments, as can be seen in FIG. 12, the first-type coupler 1010 adjoining the left-side edge may be offset from a plane P defined by the single-coupler protrusion-based net-module 1000. This offsetting of the first-type coupler 1010 with respect to the plane P may allow the rotation of a net module relative to its adjacent net modules as well as enable the zig-zag positioning of the net modules in the play configuration of the collapsible net.

It should be noted that the first-type coupler 1010 may be formed within the single-coupler protrusion-based net-module 1000, or may be manufactured separately and later attached to the single-coupler protrusion-based net-module 1000, for example, by welding, soldering, fastening, etc. The material of the first-type coupler 1010 may be a plastic, a metal, an alloy, or a composite material, having sufficient rigidity and strength.

In some embodiments, each of the single-coupler protrusion-based net-modules 1000 may be made from a rigid panel (i.e. solid panel, as shown in FIGS. 34-40), for example, having a rectangular profile. The rectangular profile may also provide a display area where an interchangeable branding panel may be attached. This allows branding space to sponsors during competitive plays in public venues by companies and groups in a highly adaptable way. In other example embodiments, the single-coupler protrusion-based net-module 1000 may have a square profile, or any other profile as well. Alternately, as shown in FIGS. 10-11, each of the single-coupler protrusion-based net-modules 1000 may include a plurality of openings formed in the rectangular profile. As will be appreciated, the plurality of openings may allow for efficient manufacturing, as the reduced surface (due the openings) has a requirement of lower compression pressure during the process of the compression molding. Moreover, the openings help in reducing the material requirement and cost and keeping the weight of the net modules low, while imparting sufficient strength to the structure of the net module.

The cross-section profile of each of the single-coupler protrusion-based net-module 1000 may be rectangular or having a I-section. The material of the single-coupler protrusion-based net-module 1000 may be a plastic, a metal, an alloy, or a composite material, having sufficient rigidity and strength.

Further, in some example embodiments, each of the single-coupler protrusion-based net-module may be made from a frame (e.g., a wire frame) defining a periphery. The periphery of the frame may include a left-side edge, a right-side edge oppositely disposed to the left-side edge, a top edge, and a bottom edge oppositely disposed to the top edge (corresponding to the left-side edge 1002, the right-side edge 1004, the top edge 1006, and the bottom edge 1008). This single-coupler protrusion-based net-module may further include a mesh adjoining at least two of the left-side edge, the right-side edge, the top edge, and the bottom edge, within the periphery defined by the frame. The mesh, for example, may be made from a solid or perforated fabric, a polymer, a composite material, etc.

Figure 13:
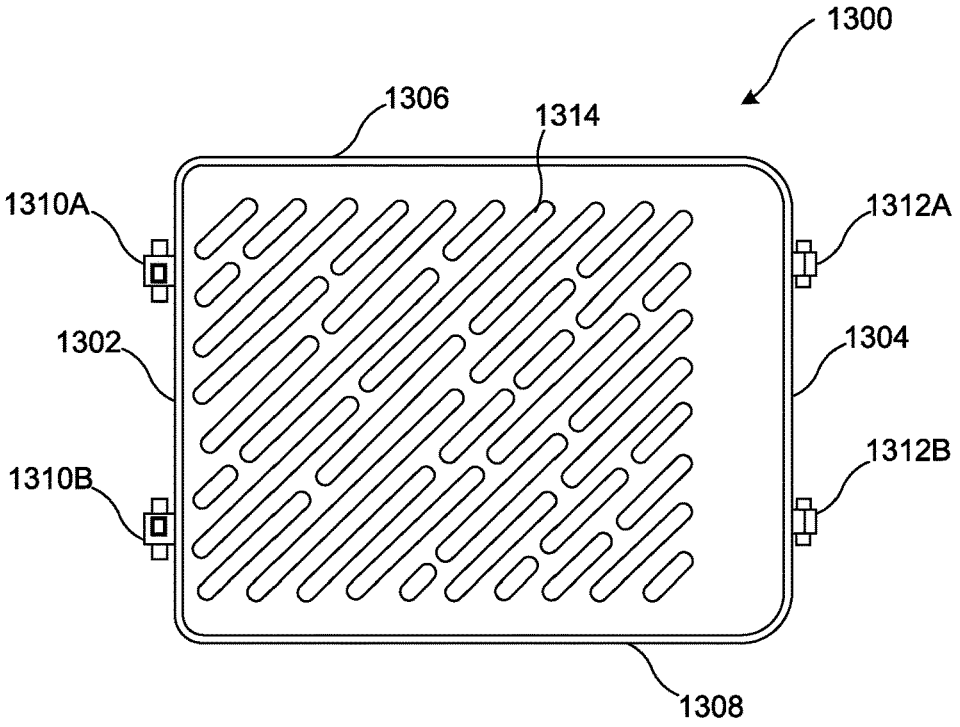
FIG. 13 illustrates a front view of a double-coupler protrusion-based net-module.
Figure 14:
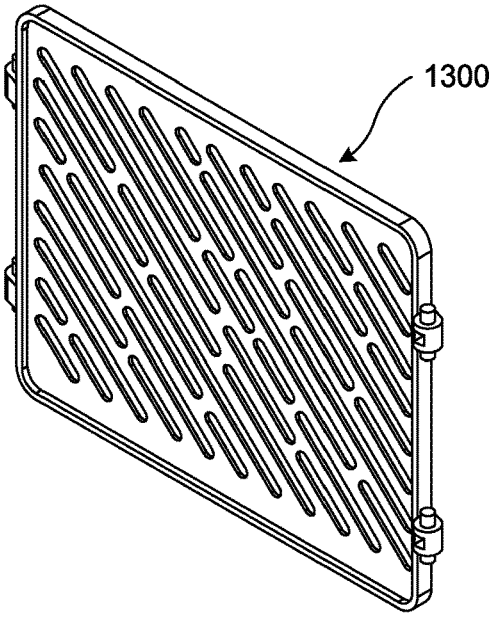
FIG. 14 illustrates a perspective view of the double-coupler protrusion-based net-module of FIG. 13.
Figure 15:
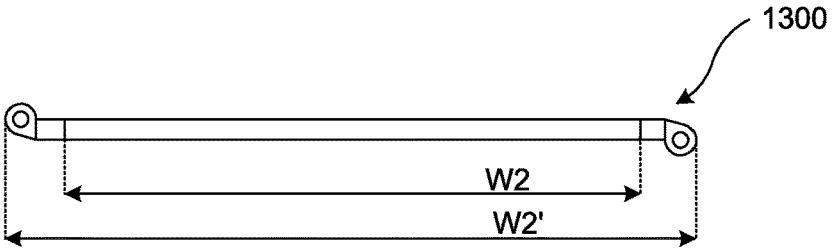
FIG. 15 illustrates a top view of the double-coupler protrusion-based net-module of FIG. 13.

FIG. 13, FIG. 14, FIG. 15 illustrate a front view, a perspective view, and a top view, respectively of a double-coupler protrusion-based net-module 1300 (corresponding to the protrusion-based net-module 502), in accordance with some configurations of the present disclosure.

The double-coupler protrusion-based net-module 1300 may include a left-side edge 1302, a right-side edge 3004 oppositely disposed to the left-side edge 1302. The double-coupler protrusion-based net-module 1300 may further include a top edge 1306 and a bottom edge 1308 oppositely disposed to the top edge 1306. The double-coupler protrusion-based net-module 1300 may further include at least one first-type coupler 1310 adjoining the left-side edge 1302 and at least one first-type coupler 1312 adjoining the right-side edge 1304.

As shown in FIGS. 13-14, in some embodiments, the double-coupler protrusion-based net-module 1300 may include two first-type couplers 1310A, 1310B adjoining the left-side edge 1302. The two first-type couplers 1310A, 1310B may be spaced apart by a predefined distance. Further, the double-coupler protrusion-based net-module 1300 may include two first-type couplers 1312A, 1312B adjoining the right-side edge 1304. The two first-type couplers 1312A, 1312B may be spaced apart by a predefined distance. Without deviating from the scope of the present subject matter, the double-coupler protrusion-based net-module 1300 may include any other number (i.e. more or less than two) of the first-type couplers 1310 as well.

As shown in FIG. 15, the left-side edge 1302 and the right-side edge 1304 may define a net-module width W2 therebetween, exclusive of the first-type couplers 1310 adjoining the left-side edge 1302 and the first-type couplers 1312 adjoining the right-side edge 1304. Further, the left-side edge 1302 and the right-side edge 1304 may define a net-module width W2' therebetween, inclusive of the first-type couplers 1310 adjoining the left-side edge 1302 and the first-type couplers 1312 adjoining the right-side edge 1304. In some embodiments, the width W1 between the left-side edge 1002 and the right-side edge 1004 (exclusive of the first-type couplers 1010) may be same as width W2 between the left-side edge 1302 and the right-side edge 1304 (exclusive of the first-type couplers 1310 adjoining the left-side edge 1302 and the first-type couplers 1312 adjoining the right-side edge 1304). This allows for symmetrical stacking of the single-coupler protrusion-based net-modules 1100 and the double-coupler protrusion-based net-modules 1300, when the collapsible net is configured in the stowed configuration.

The first-type coupler 1310 may be configured as at least one first-type hinge including a pin protrusion adjoining at least a portion of the left-side edge 1302 of the double-coupler protrusion-based net-module 1300. As shown in FIG. 13, the pin protrusion may include two protrusions emanating above and below, respectively of a middle body. In some embodiments, as can be seen in FIG. 15, the first-type coupler 1310 adjoining the left-side edge 1302 may be offset from a plane P defined by the double-coupler protrusion-based net-module 1300. Further, the first-type coupler 1312 adjoining the right-side edge 1304 may be offset from a plane P defined by the double-coupler protrusion-based net-module 1300. Furthermore, the first-type coupler 1310 adjoining the left-side edge 1302 may be facing opposite to the first-type coupler 1312 adjoining the right-side edge 1304. This offsetting may allow the rotation of a net module relative to its adjacent net modules as well as enable the zig-zag positioning of the net modules in the play configuration of the collapsible net.

By way of an example, the first-type coupler 1310 may be formed within the double-coupler protrusion-based net-module 1300, or may be manufactured separately and later attached to the double-coupler protrusion-based net-module 1300, for example, by welding, soldering, fastening, etc. The material of the first-type coupler 1310 may be a plastic, a metal, an alloy, or a composite material, having sufficient rigidity and strength.

In some embodiments, each of the double-coupler protrusion-based net-module 1300 may be made from a rigid panel (i.e. solid panel, as shown in FIGS. 34-40), for example, having a rectangular profile. In other example embodiments, the double-coupler protrusion-based net-module 1300 may have a square profile, or any other profile as well. Further, as shown in FIGS. 13-14, each of the double-coupler protrusion-based net-module 1300 may include a plurality of openings 1314 formed in the rectangular profile. As mentioned above, the plurality of openings 1314 may allow for efficient manufacturing, as the reduced surface (due the openings) has a requirement of lower compression pressure during the process of the compression molding. Moreover, the openings 1314 help in reducing the material requirement and cost and keeping the weight of the net modules low, while imparting sufficient strength to the structure of the net module.

The cross-section profile of each of the double-coupler protrusion-based net-module 1300 may be rectangular or having a I-section. The material of the double-coupler protrusion-based net-module 1300 may be a plastic, a metal, an alloy, or a composite material, having sufficient rigidity and strength.

Further, in some example embodiments, each of the double-coupler protrusion-based net-module may be made from a frame (e.g., a wire frame) defining a periphery. The periphery of the frame may include a left-side edge, a right-side edge oppositely disposed to the left-side edge, a top edge, and a bottom edge oppositely disposed to the top edge (corresponding to the left-side edge 1302, the right-side edge 1304, the top edge 1306, and the bottom edge 1308). This double-coupler protrusion-based net-module may further include a mesh adjoining at least two of the left-side edge, the right-side edge, the top edge, and the bottom edge, within the periphery defined by the frame. The mesh, for example, may be made from a solid or perforated fabric, a polymer, a composite material, etc.

Figure 16:
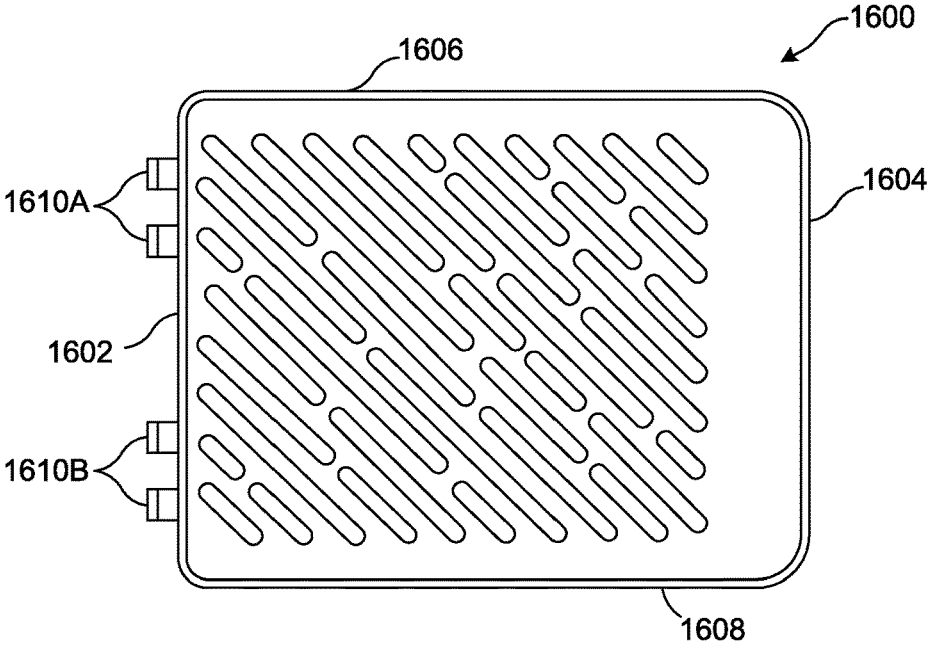
FIG. 16 illustrates a front view of a single-coupler receptacle-based net-module.
Figure 17:
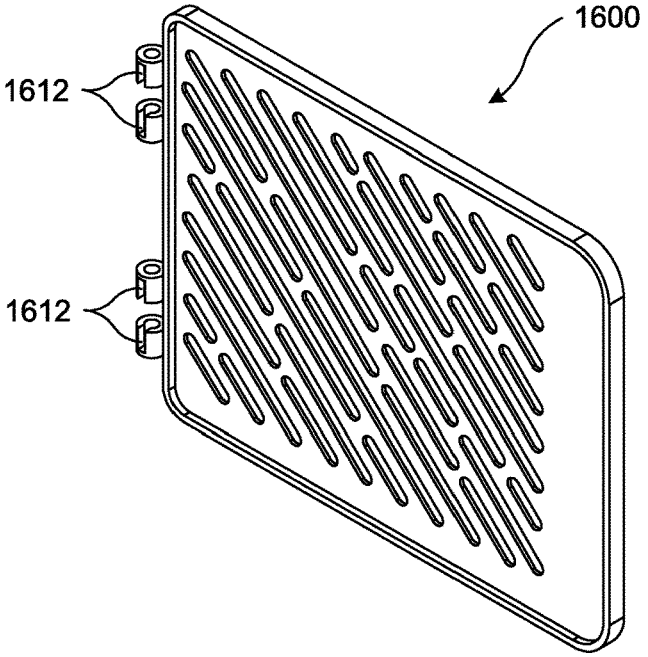
FIG. 17 illustrates a perspective view of the single-coupler receptacle-based net-module of FIG. 16.
Figure 18:
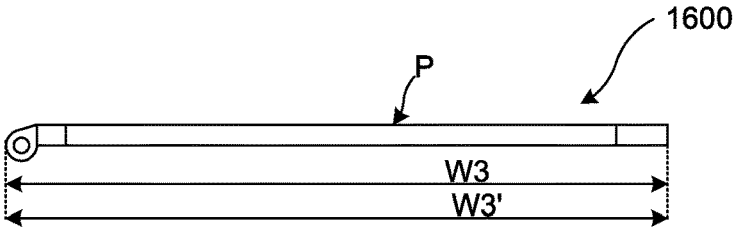
FIG. 18 illustrates a top view of the single-coupler receptacle-based net-module of FIG. 16.

FIG. 16, FIG. 17, FIG. 18 illustrate a front view, a perspective view, and a top view, respectively of a single-coupler receptacle-based net-module 1600 (corresponding to the receptacle-based net-module 504), in accordance with some configurations of the present disclosure.

The single-coupler receptacle-based net-module 1600 may include a left-side edge 1602, a right-side edge 1604 oppositely disposed to the left-side edge 1602. The single-coupler receptacle-based net-module 1600 may further include a top edge 1606 and a bottom edge 1608 oppositely disposed to the top edge 1606. The single-coupler receptacle-based net-module 1600 may further include a second-type coupler 1610 adjoining one of the left-side edge 1602 and the right-side edge 1604. For example, in some embodiments, as shown in FIGS. 16-18, the single-coupler receptacle-based net-module 1600 may include the second-type coupler 1610 adjoining the left-side edge 1602.

As shown in FIGS. 16-17, in some embodiments, the single-coupler receptacle-based net-module 1600 may include two second-type couplers 1610A, 1610B on the left-side edge 1602. The two second-type couplers 1610A, 1610B (also collectively referred to as second-type couplers 1610 in this disclosure) may be spaced apart by a predefined distance. It should be noted that in alternate embodiments, the single-coupler receptacle-based net-module 1600 may include any other number (i.e. more or less than two) of the second-type couplers 1610.

As shown in FIG. 18, the left-side edge 1602 and the right-side edge 1604 define a net-module width W3 therebetween, exclusive of the second-type couplers 110). The left-side edge 1602 and the right-side edge 1604 may define a net-module width W3' therebetween, inclusive of the second-type couplers 1610. The width W3 may be equal to the widths W1 and W2, as mentioned above. Further, the width W3' may be equal to the width W1'. As will be appreciated, the equal width of the net modules may allow for the symmetrical stacking of the net modules in the stowed configuration of the collapsible net.

The second-type coupler 1610 may be configured as at least one second-type hinge including a pin-receptacle adjoining at least a portion of the left-side edge 1602 of the single-coupler receptacle-based net-module 1600. Further, as shown in FIG. 16, the pin-receptacle may include two receptacles positioned close to each other and separated by a gap. The gap may accommodate the middle body of the first-type coupler, when the receptacle-based net-module is coupled with the protrusion-based net-module.

As can be seen in FIG. 17, the pin-receptacle of each of the second-type coupler 1610A, 1610B may include a cut-out 1612. The cut-out 1612 may be provided to allow the protrusion of the first-type coupler to be detachably engaged with the pin-receptacle of the second-type couplers 1610A, 1610B. in other words, the cut-out 1612 may provide an opening to allow the protrusion-based net-modules to be coupled with and decoupled from the receptacle-based net-modules, simply by applying a force.

In some embodiments, as can be seen in FIG. 18, the second-type coupler 1610 adjoining the left-side edge may be offset from a plane P defined by the single-coupler receptacle-based net-module 1600. This offsetting of the second-type coupler 1610 with respect to the plane P may allow the rotation of a net module relative to its adjacent net modules as well as enable the zig-zag positioning of the net modules in the play configuration of the collapsible net.

It should be noted that the second-type coupler 1610 may be formed within the single-coupler receptacle-based net-module 1600, or may be manufactured separately and later attached to the single-coupler receptacle-based net-module 1600, for example, by welding, soldering, fastening, etc. The material of the second-type coupler 1610 may be a plastic, a metal, an alloy, or a composite material, having sufficient rigidity and strength.

In some embodiments, each of the single-coupler receptacle-based net-module 1600 may be made from a rigid panel (i.e. solid panel, as shown in FIGS. 34-40), for example, having a rectangular profile. In other example embodiments, the single-coupler receptacle-based net-module 1600 may have a square profile, or any other profile as well. Further, as shown in FIGS. 16-17, each of the single-coupler receptacle-based net-module 1600 may include a plurality of openings formed in the rectangular profile, similar to that of receptacle-based net-modules, as described above. The cross-section profile of each of the single-coupler receptacle-based net-module 1600 may be rectangular or having a I-section. The material of the single-coupler receptacle-based net-module 1600 may be a plastic, a metal, an alloy, or a composite material, having sufficient rigidity and strength.

In some example embodiments, each of the single-coupler receptacle-based net-module may be made from a frame (e.g., a wire frame) defining a periphery. The periphery of the frame may include a left-side edge, a right-side edge oppositely disposed to the left-side edge, a top edge, and a bottom edge oppositely disposed to the top edge. This single-coupler receptacle-based net-module may further include a mesh adjoining at least two of the left-side edge, the right-side edge, the top edge, and the bottom edge, within the periphery defined by the frame. The mesh, for example, may be made from a solid or perforated fabric, a polymer, a composite material, etc.

Figure 19:
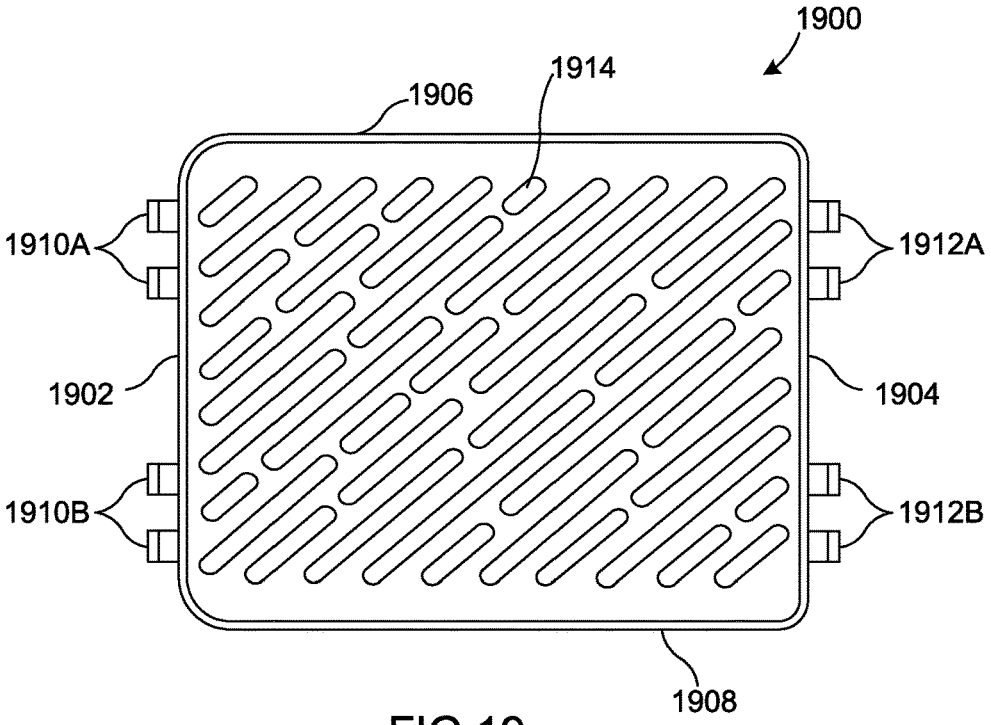
FIG. 19 illustrates a front view of a double-coupler receptacle-based net-module.
Figure 20:
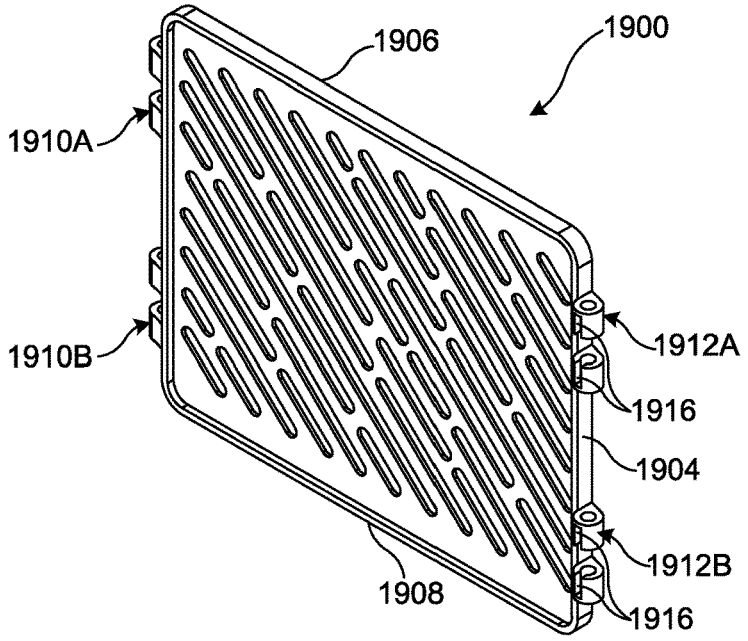
FIG. 20 illustrates a perspective view of the double-coupler receptacle-based net-module of FIG. 19.
Figure 21:
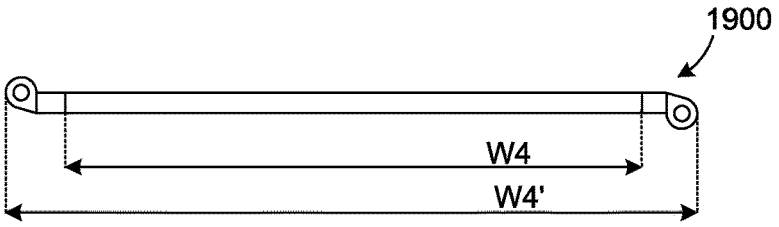
FIG. 21 illustrates a top view of the double-coupler receptacle-based net-module of FIG. 19.

FIG. 19, FIG. 20, FIG. 21 illustrate a front view, a perspective view, and a top view of a double-coupler receptacle-based net-module 1900 (corresponding to the receptacle-based net-module 504), in accordance with some configurations of the present disclosure.

The double-coupler receptacle-based net-module 1900 may include a left-side edge 1902, a right-side edge 1904 oppositely disposed to the left-side edge 1902. The double-coupler receptacle-based net-module 1900 may further include a top edge 1906 and a bottom edge 1908 oppositely disposed to the top edge 1906. The double-coupler receptacle-based net-module 1900 may further include at least one second-type coupler 1910 adjoining the left-side edge 1902 and at least one second-type coupler 1912 adjoining the right-side edge 1904.

As shown in FIGS. 13-14, in some embodiments, the double-coupler receptacle-based net-module 1900 may include two second-type couplers 1910A, 1910B adjoining the left-side edge 1902. The two second-type couplers 1910A, 1910B may be spaced apart by a predefined distance. Further, the double-coupler receptacle-based net-module 1900 may include two second-type couplers 1912A, 1912B adjoining the right-side edge 1904. The two second-type couplers 1912A, 1912B may be spaced apart by a predefined distance. Without deviating from the scope of the present subject matter, the double-coupler receptacle-based net-module 1900 may include any other number (i.e. more or less than two) of the second-type couplers 1910 as well.

As shown in FIG. 21, the left-side edge 1902 and the right-side edge 1904 may define a net-module width W4 therebetween, exclusive of the second-type couplers 1910 adjoining the left-side edge 1902 and the second-type couplers 1912 adjoining the right-side edge 1904. Further, left-side edge 1902 and the right-side edge 1904 may define a net-module width W4' therebetween, inclusive of the second-type couplers 1910 adjoining the left-side edge 1902 and the second-type couplers 1912 adjoining the right-side edge 1904. In some embodiments, the width W2 between the left-side edge 1302 and the right-side edge 1304 (exclusive of the first-type couplers 1010) may be same as width W4 between the left-side edge 1902 and the right-side edge 1904 (exclusive of the second-type couplers 1910 adjoining the left-side edge 1902 and the second-type couplers 1912 adjoining the right-side edge 1904). This allows for symmetrical stacking of the single-coupler receptacle-based net-modules, the single-coupler protrusion-based net-modules, the double-coupler receptacle-based net-modules, and the double-coupler protrusion-based net-modules, when the collapsible net is configured in the stowed configuration.

As can be seen in FIG. 20, the pin-receptacle of each of the second-type coupler 1910A, 1910B may include a cut-out 1916. Similarly, the pin-receptacle of each of the second-type coupler 1912A, 1912B may include a cut-out 1916. The cut-out 1916 may be provided to allow the protrusion of the first-type coupler to be detachably engaged with the pin-receptacle of the second-type couplers 1910A, 1910B. In other words, the cut-out 1916 may provide an opening to allow the protrusion-based net-modules to be coupled with and decoupled from the receptacle-based net-modules, simply by applying a force.

The second-type coupler 1910 may be configured as at least one second-type hinge including a pin-receptacle adjoining at least a portion of the left-side edge 1902 and the right-side edge 1904 of the double-coupler receptacle-based net-module 1900. As shown in FIG. 19, the pin-receptacle may include two receptacles positioned close to each other and separated by a gap. The gap may accommodate the middle body of the first-type coupler, when the receptacle-based net-module is coupled with the protrusion-based net-module. In some embodiments, as can be seen in FIG. 21, the second-type coupler 1910 adjoining the left-side edge 1902 may be offset from a plane P defined by the double-coupler receptacle-based net-module 1900. Further, the second-type coupler 1912 adjoining the right-side edge 1904 may be offset from a plane P defined by the double-coupler receptacle-based net-module 1900. Furthermore, the second-type coupler 1910 adjoining the left-side edge 1902 may be facing opposite to the second-type coupler 1912 adjoining the right-side edge 1904. This offsetting may allow the rotation of a net module relative to its adjacent net modules as well as enable the zig-zag positioning of the net modules in the play configuration of the collapsible net.

By way of an example, the second-type coupler 1910 may be formed within the double-coupler receptacle-based net-module 1900, or may be manufactured separately and later attached to the double-coupler receptacle-based net-module 1900, for example, by welding, soldering, fastening, etc. The material of the second-type coupler 1910 may be a plastic, a metal, an alloy, or a composite material, having sufficient rigidity and strength.

In some embodiments, each of the double-coupler receptacle-based net-module 1900 may be made from a rigid panel (i.e. solid panel, as shown in FIGS. 34-40), for example, having a rectangular profile. In other example embodiments, the double-coupler receptacle-based net-module 1900 may have a square profile, or any other profile as well. Further, as shown in FIGS. 19-20, each of the double-coupler receptacle-based net-module 1900 may include a plurality of openings 1914 formed in the rectangular profile. As mentioned above, the plurality of openings 1914 may allow for efficient manufacturing, as the reduced surface (due the openings) has a requirement of lower compression pressure during the process of the compression molding. Moreover, the openings 1914 help in reducing the material requirement and cost and keeping the weight of the net modules low, while imparting sufficient strength to the structure of the net module.

The cross-section profile of each of the double-coupler receptacle-based net-module 1900 may be rectangular or having a I-section. The material of the double-coupler receptacle-based net-module 1900 may be a plastic, a metal, an alloy, or a composite material, having sufficient rigidity and strength.

Further, in some example embodiments, each of the double-coupler receptacle-based net-module may be made from a frame (e.g., a wire frame) defining a periphery. The periphery of the frame may include a left-side edge, a right-side edge oppositely disposed to the left-side edge, a top edge, and a bottom edge oppositely disposed to the top edge (corresponding to the left-side edge 1902, the right-side edge 1904, the top edge 1906, and the bottom edge 1908). This double-coupler receptacle-based net-module may further include a mesh adjoining at least two of the left-side edge, the right-side edge, the top edge, and the bottom edge, within the periphery defined by the frame. The mesh, for example, may be made from a solid or perforated fabric, a polymer, a composite material, etc.

Figure 22:
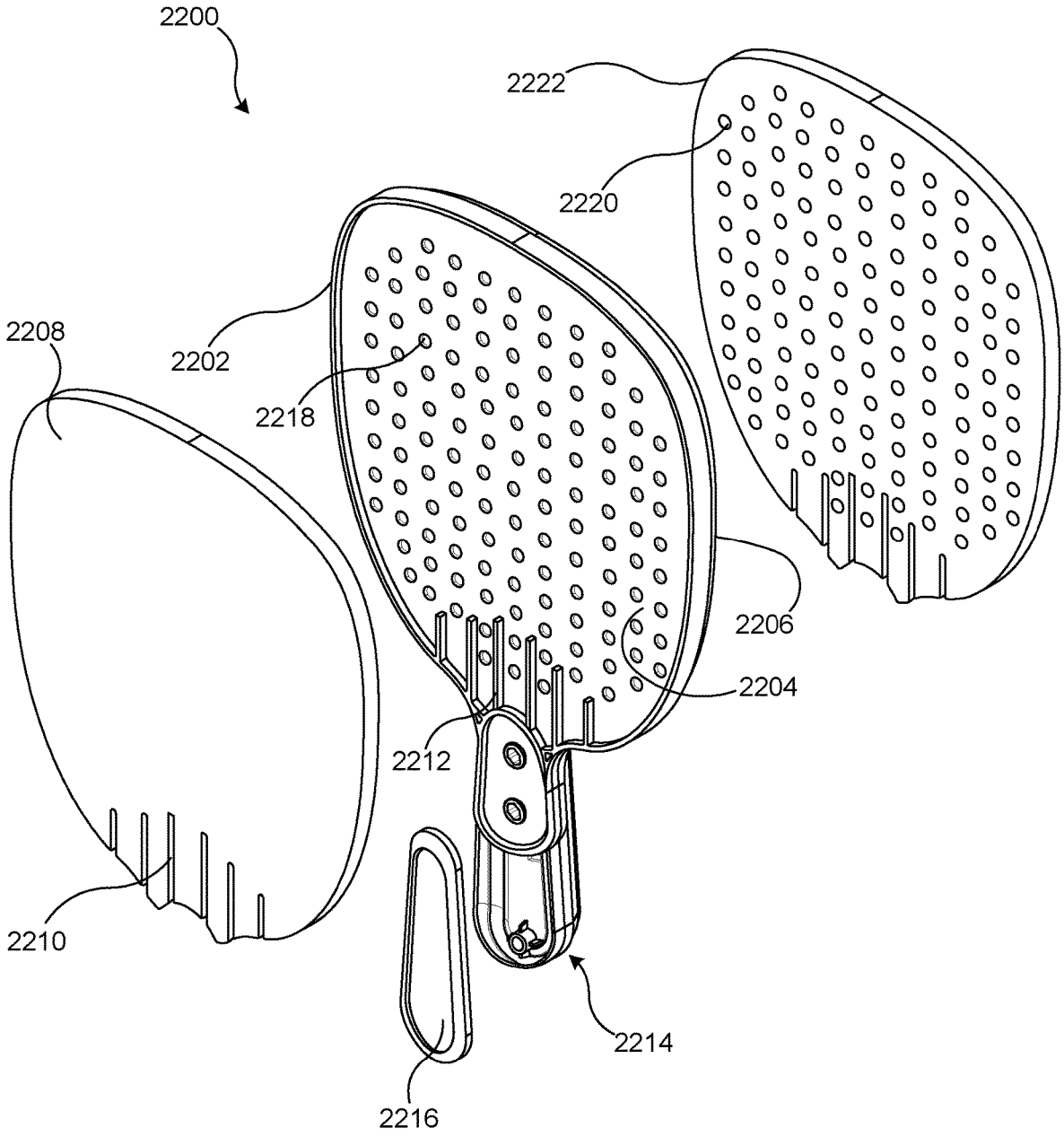
FIG. 22 is an exploded view of an illustrative configuration of a paddle.

Referring now to FIG. 22, an exploded view of a paddle 2200 (corresponding to the paddle 102) is illustrated, in accordance with some embodiments. The paddle 2200 may include a flat panel 2202, which may define a top surface 2204 and a bottom surface 2206. The flat panel 2202 may be shaped like any table tennis racket and therefore may have an asymmetrical ovular shape. It may be noted that the various other different shapes of the flat panel 2202 are possible as well. The paddle 2200 may further include a first elastic panel 2208 attached to the top surface 2204, and a second elastic panel 2222 attached to the bottom surface 2206. The first elastic panel 2208 and the second elastic panel 2222 may be made from an elastic material, such as rubber, or any polymer. Further, the first elastic panel 2208 and the second elastic panel 2222 may be attached to the flat panel 2202, for example, via an adhesive. Alternately, the first elastic panel 2208 and the second elastic panel 2222 may be attached to the flat panel 2202, via other means, such as fasteners (e.g. nails, screws, nuts, rivets, etc.), stitches, or mechanical couplers. For example, in some example configurations, the first elastic panel 2208 and the second elastic panel 2222 may include dimples 2220 which may be configured to engage with receptacles 2218 formed on the top surface 2204 and the bottom surface 2206 of the flat panel 2202. In some example embodiments, the flat panel 2202 may be made from material having high tensile strength, high flexibility, good creep, and high impact strength (toughness), such as Polyamide.

In some embodiments, the first elastic panel 2208 and the second elastic panel 2222 may include a plurality of cut-outs 2210 which may be adjoining a handle 2214. The plurality of cut-outs 2210 may be configured to enable a grip while holding the paddle 2200, during the game play. The cut-outs 2210 may provide friction to prevent slippage of the paddle 2200 from the hand of the player during the game play.

The first elastic panel 2208 and the second elastic panel 2222 may have a shape and size in accordance with the shape and size of the flat panel 2202. Further, the first elastic panel 2208 and the second elastic panel 2222 may have a predefined hardness. In some example embodiments, the hardness of the first elastic panel 2208 and the second elastic panel 2222 may be the same or lower than a hardness of a typical table tennis racket. In particular, the hardness of the first elastic panel 2208 and the second elastic panel 2222 may vary between a range of 0 to 30 pounds per square inch (PSI) where hardness of ultra-soft foam compresses easily at under 4 PSI, while harder foam resists compression of 20, 30, or even 40 PSI. The hardness rating is measured in pounds per square inch (PSI) and indicates how much force is required to compress 25%. As will be appreciated, the low hardness may allow for a game play different from the typical game of table tennis. Due to the low hardness, the game play using the paddle 2200 may be slower than the typical game of table tennis.

The first elastic panel 2208 and the second elastic panel 2222 may be made from a material like open cell foam or open cell sponge. Such materials offer unique properties like that of a spring by returning to the original state following compression. This is due to the chemical make up of the material and the free-flowing movement of air. As such, breathable and soft open cell sponge can easily conform to sealing applications. Further, the open cell sponge can be manufactured in a wide spectrum of hardness. In some example configurations, the material of the first elastic panel 2208 and the second elastic panel 2222 may be Ethylene-vinyl acetate (EVA), having a hardness of 25 Durometers with a tolerance of −3 to +3 (Durometer is a dimensionless quantity and a standardized way of measuring hardness of materials).

Figure 23:
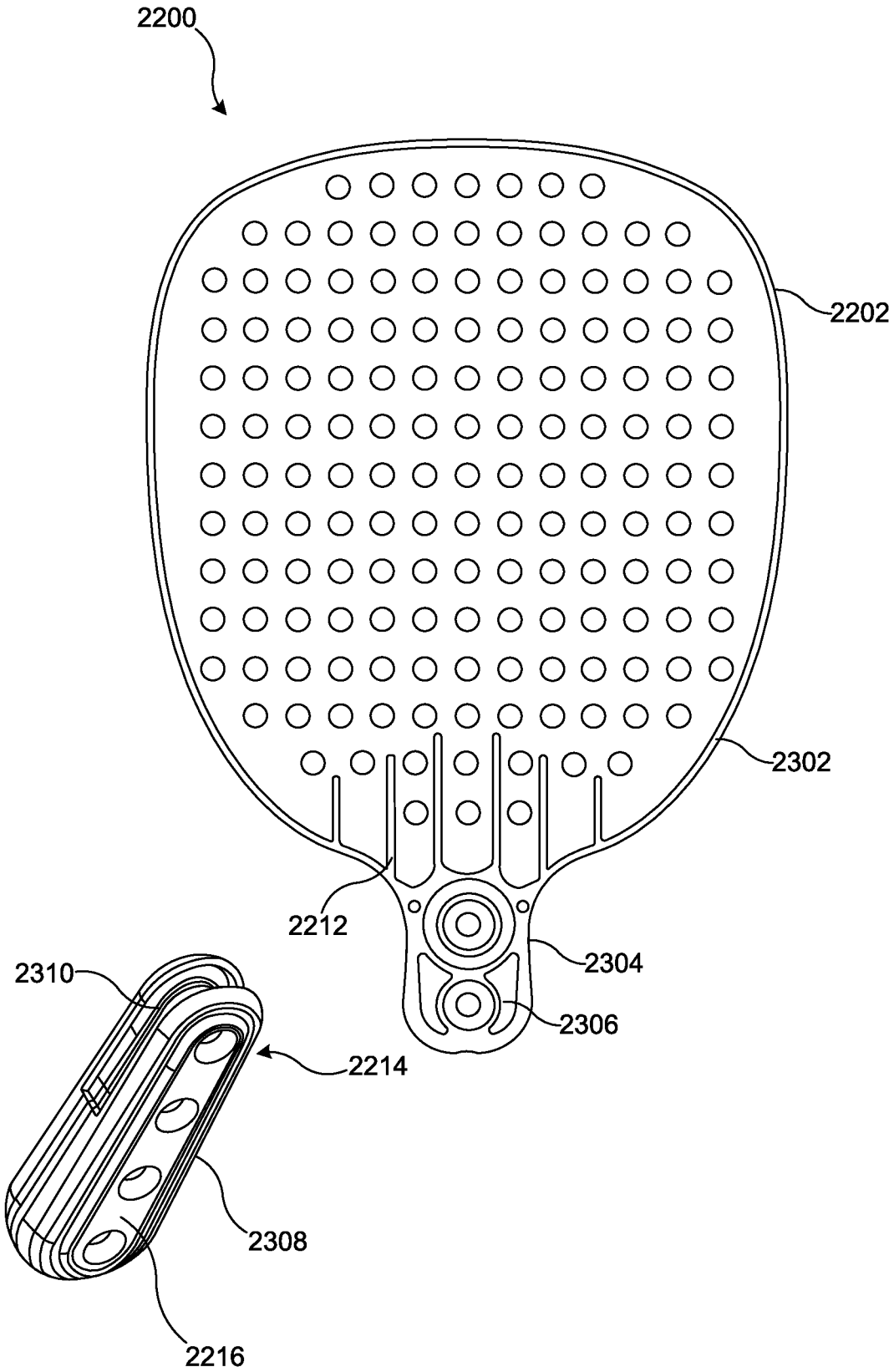
FIG. 23 illustrates a front view of an elastic panel of the paddle of FIG. 22, wherein the elastic panel may be configuration in a shape and size in accordance with the shape and size of the paddle.

Referring now to FIG. 23, another exploded view of the paddle 2200 is illustrated, in accordance with some embodiments.

The paddle 2200 may include the flat pane 2202 and the handle 2214. The handle 2214 may be made from a Polycarbonate or Acrylonitrile Butadiene Styrene (ABS) material which provide high heat strength, heat resistance, and flexibility. The handle 2214 may be configured to be attached to the flat panel 2202, by way of a mechanical coupling, a magnetic coupling, or using fasteners. For example, the handle 2214 or the flat panel 2202 may include a magnetic member, which may allow the handle to fit and attach with the flat panel 2202. For example, as shown in FIG. 23, the flat panel 2202 may include one or more magnetic members 2306 and the handle 2214 may also include one or more magnetic members or iron members on an extended section 2304 of the flat panel 2202, which may allow the handle 2214 to attach with the flat panel 2202. Further, the handle 2214 may include a slot 2310 which may fit around the extended section 2304 of the flat panel 2202 to thereby attach with the flat pane 2202. This further allows interchangeability of the handles, to suit different players.

In some embodiments, the flat panel 2202 may include a splined inset 2302 along the periphery of the flat panel 2202. The splined inset 2302 may allow the flat panel 2202 to naturally form around the thumb and forefinger of the player. Further, the handle 2214 may include a palm flare 2308 formed around the periphery of the handle 2214 on both the front and the rear side of the handle 2214. The palm flare 2308 may be a protruding structure which creates a natural taper of the handle 2214 (slimming upwards) for natural ergonomic gripping during play. The palm flare 2308 may have a multi-direction taper (along x-axis as well as y-axis) for further improving the natural grip.

Once again referring again to FIG. 22, the flat panel 2202 may further include a plurality of ridges 2212 formed on the surface of the flat panel 2202. The ridges 2212, like the plurality of cut-outs 2210, may add to the friction and prevent slippage of the paddle 2200 from the hand of the player during the game play. The ridges 2212 may be made of the same material as of the flat panel 2202, or of any other high-friction material, such as rubber or a plastic. The ridges 2212 and the cut-outs for example, may be linear and oriented parallel to a central axis of the handle 2214. The ridges 2212 may allow to naturally form around thumb and forefinger.

The handle 2214 may be configured to allow a player to hold the paddle 2200 during the game play. The handle 2014, for example, may be formed within the flat panel 2202, or otherwise may be manufactured separately and then attached to the flat panel 2002, for example, via a mechanical coupler, one or fasteners (e.g. nails, screws, nuts, rivets etc.), an adhesive, etc. In some embodiments, the handle 2214 may include a gripping pad attached to one or both sides (i.e. front side and back side) of the handle 2214. The gripping pad 2216 may be made from a high friction material like a rubber or a plastic. The gripping pad 2216 may be attached to a core of the handle 2214, for example, via an adhesive, a mechanical coupler, or a fastener. Further, the gripping pad 2216 may provide anti-bacterial properties and high washability. Moreover, in some embodiments, the gripping pad 2216 may be replaceable. The gripping pad 2216 may be manufactured from an elastomer or rubber-like material. For example, such a material may include silicone or composite material made form silicone together with Carbon, Hydrogen, and Oxygen, and may include a siloxane back (silicon-oxygen chain) and an organic moiety bound to the silicon.

Figure 24:
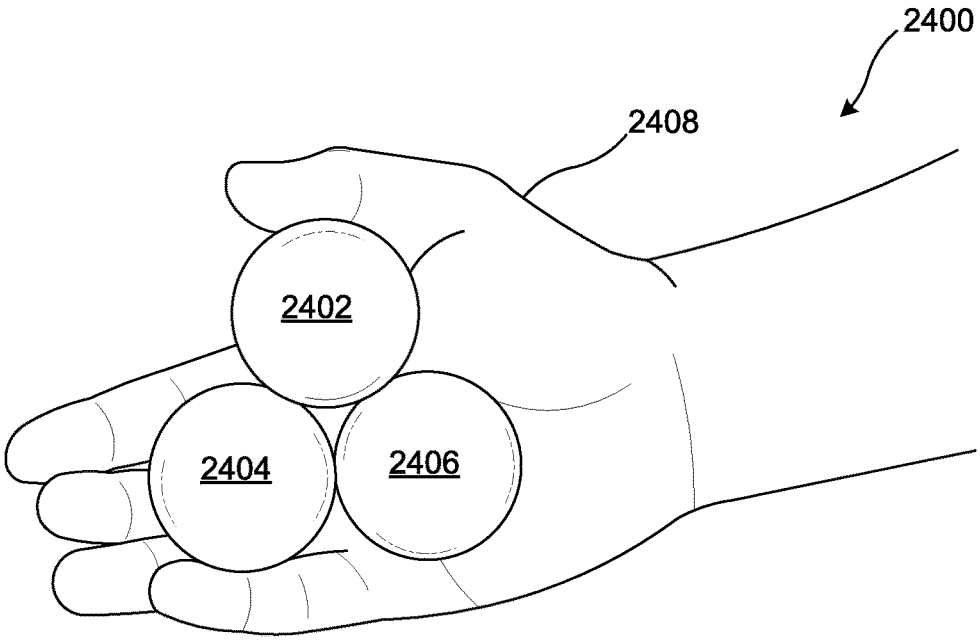
FIG. 24 illustrates a view of balls of a game apparatus showing the proportionate size of the balls with respect to an adult human hand.
Figure 25:
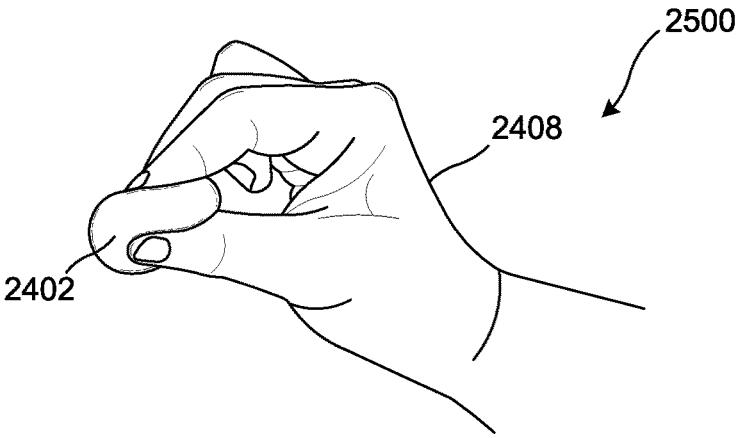
FIG. 25 illustrates a view of a ball of the balls of FIG. 24 indicting a hardness associated therewith.
Figure 26:
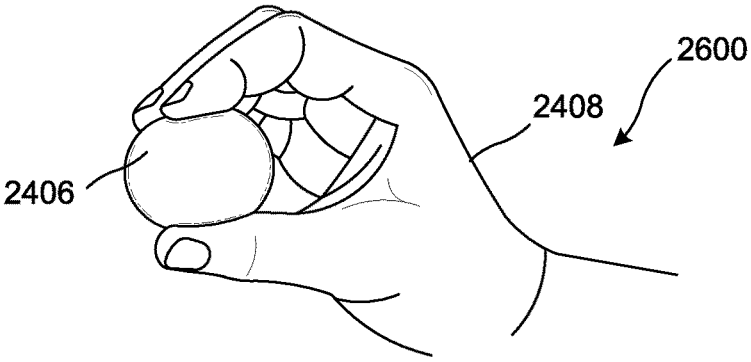
FIG. 26 illustrates a view of another ball of the balls of FIG. 24 indicting a hardness associated therewith.

Referring now to FIGS. 24-26, various different views 2400, 2500, 2600 of balls 2402, 2404, 2406 (corresponding to the balls 104, 106, 108) are illustrated, in accordance with some embodiments. As mentioned above, the game apparatus 100 may include at least three balls, each having a hardness different from the other. FIG. 24 shows the proportionate size of the balls with respect to an adult human hand 2408. For example, the size of each of the three balls 2402, 2404, 2406 may be same and similar to the size of a typical table tennis ball. However, size different than the typical table tennis ball may be possible in some embodiments.

It should be noted that each ball may offer a different experience of game play therewith due to its hardness. For example, the ball (amongst the balls 2402, 2404, 2406) having the lowest hardness (i.e. softest) may offer a slower game play, whereas the ball having the highest hardness (i.e. stiffest) may offer a relatively faster game play. For example, as shown in FIG. 25, the ball 2402 may have the lowest hardness and therefore may be softest and easily compressible with between a thumb and a finger of the hand 2408 of the user. Further, as shown in FIG. 26, the ball 2406 may have the highest hardness and therefore may be the stiffest and therefore easily not as compressible as the ball 2402. In particular, the hardness of the ball 2402 may vary between a range of 0 to 10 PSI, the hardness of the ball 2404 may vary between a range of 10 to 30 PSI, and the hardness of the ball 2406 may vary between a range of 30 to 50 PSI. It is noted that these specific examples of hardness may be varied and/or measured in different units of measure such as, for example, modulus of elasticity, rebound percentage, energy absorption, etc. The above ranges are provided in one illustrative configuration to express that one ball is 'soft,' one is 'medium,' and one is 'harder.'

In some embodiments, each of the balls 2402, 2404, 2406 may be made from the same material. However, the density of the balls 2402, 2404, 2406 may differ which may impart the different hardness to each ball. As such, the ball with the higher density may be stiffest and having the highest hardness, and the ball with the lowest density may be the softest and having the lowest hardness. For example, density of each of the balls 2402, 2404, 2406 may be less than 20 kilogram per meter cube, and preferable within a range of 7 to 14 kilogram per meter cube. This allows the balls 2402, 2404, 2406 to absorb most of the mechanical energy to thereby slow the game and equalize the mechanical advantage to the players. In some example configurations, each of the balls 2402, 2404, 2406 may be made from Polyurethane (PU) foam. Further, one of the balls 2402, 2404, 2406 (e.g. ball 2402) may have a density of 90 kilograms per cubic metre (kg/m3), another ball (e.g. ball 2404) may have a density of 60 kg/m3, and the remaining ball (e.g. ball 2406) may have a density of 45 kg/m3.

Alternately, each of the balls 2402, 2404, 2406 may be made from the different material, each material having an associated hardness, which may therefore impart different degree of softness and stiffness to the balls.

By way of an example, the balls 2402, 2404, 2406 may be manufactured from open cell sponge or open cell foam, for the same properties of the material as for the elastic panels of the paddles.

Figure 27:
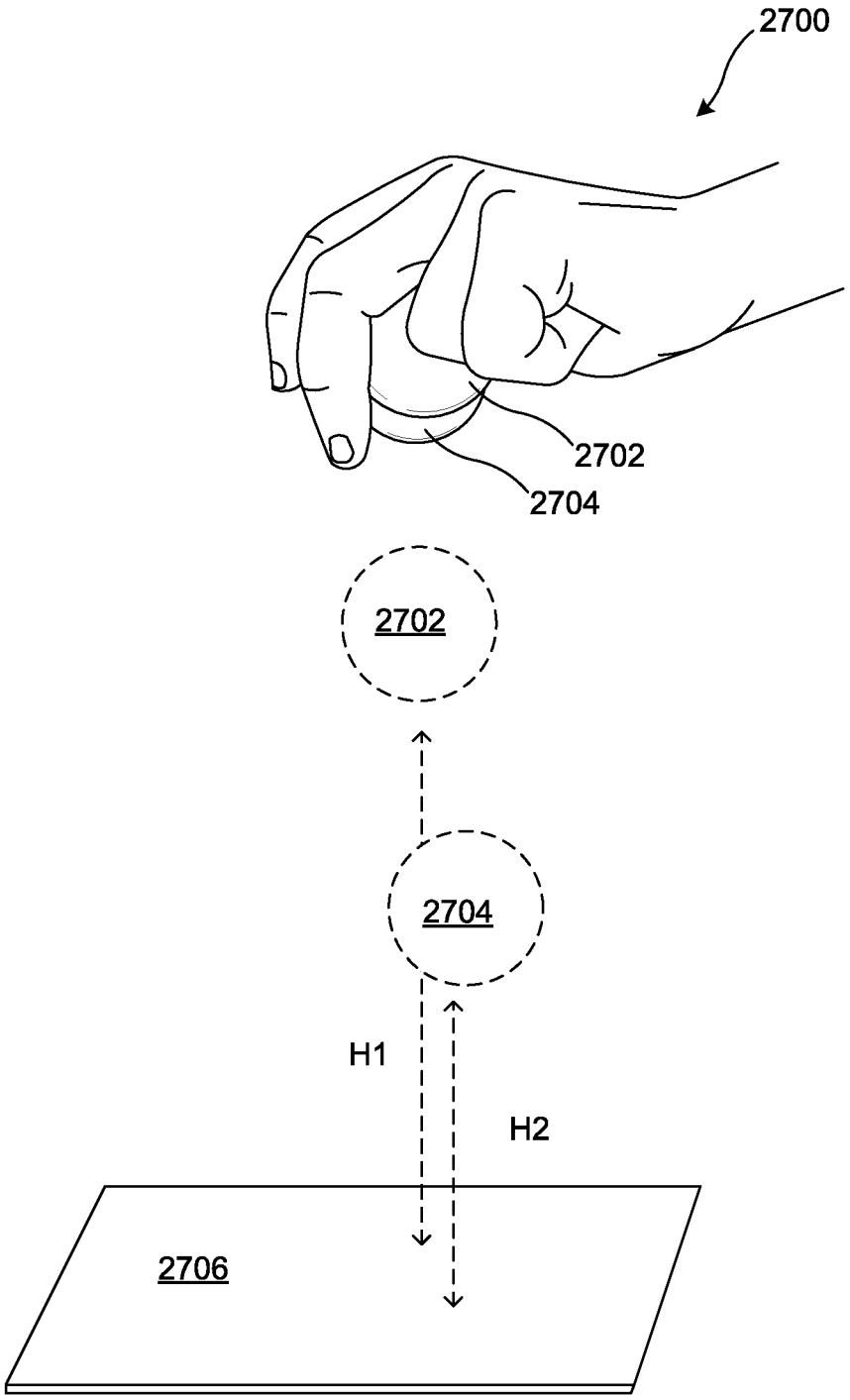
FIG. 27 illustrates a scenario of dropping two balls from the same height on a surface and their respective bounce.

As will be appreciated, due to the difference in the hardness of the three balls 2402, 2404, 2406, each ball may have a different bounce, as compared to the other. As will be further appreciated, the hardness is directly proportional to the ability to bounce off a surface. As such, the ball having a higher hardness may experience a greater bounce than a ball having a relatively lower hardness. This is further explained in conjunction with the FIG. 27. FIG. 27 illustrates a scenario 2700 of dropping two balls 2702, 2704 (e.g. corresponding to the balls 2402, 2404, 2406) from the same height on a surface 2706, in accordance with some embodiments. Further, the ball 2702 may have a higher hardness as compared to that of the ball 2704. As such, when dropped from the same height, the ball 2702 may bounce to a rebound-height H1, while the ball 2704 may bounce to a rebound-height H2. Since the ball 2702 has a higher hardness, rebound-height H1 of the ball 2702 may be higher than the rebound-height H2 of the ball 2704. Therefore, the ball 2702, owing to its higher hardness may offer a faster game play, as compared with the ball 2704.

It should be noted that without deviating from the scope of the present disclosure, various other embodiments of the collapsible net and of the net modules may be possible. For example, the first-type coupler and the second-type coupler may be configured as other mechanical or magnetic couplers, instead of the first-type hinge and the second-type as described above. Some of the possible embodiments of the collapsible net and of the net modules are described below.

For example, in some embodiments of the first-type coupler and the second-type coupler configured as mechanical couplers, the first-type coupler may include at least one first-type hinge and the second-type coupler may include at least one second-type hinge configured to rotate relative to the first-type hinge. The at least one first-type hinge may be engaged with the at least one second-type hinge. Further, the at least one first-type hinge may be vertically offset from the at least one second-type hinge, to allow the first-type hinge of one net-module to align with the second-type hinge of another adjacent net-module. Once aligned, the first-type hinge and the second-type hinge of the adjacent net-modules may be coupled using a pin.

Figure 28:
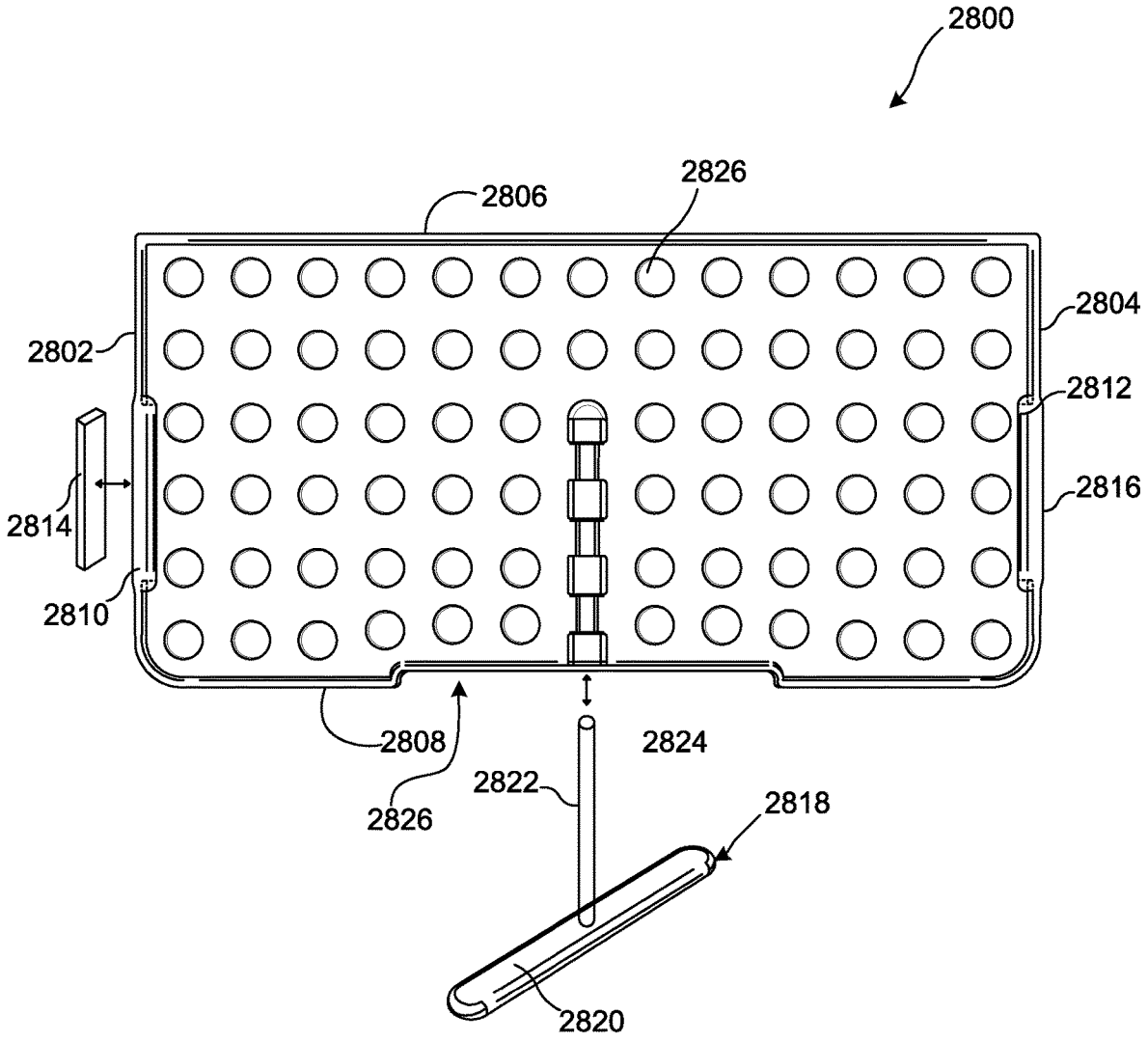
FIG. 28 illustrates an exploded view of an illustrative configuration of a net module.
Figure 29:
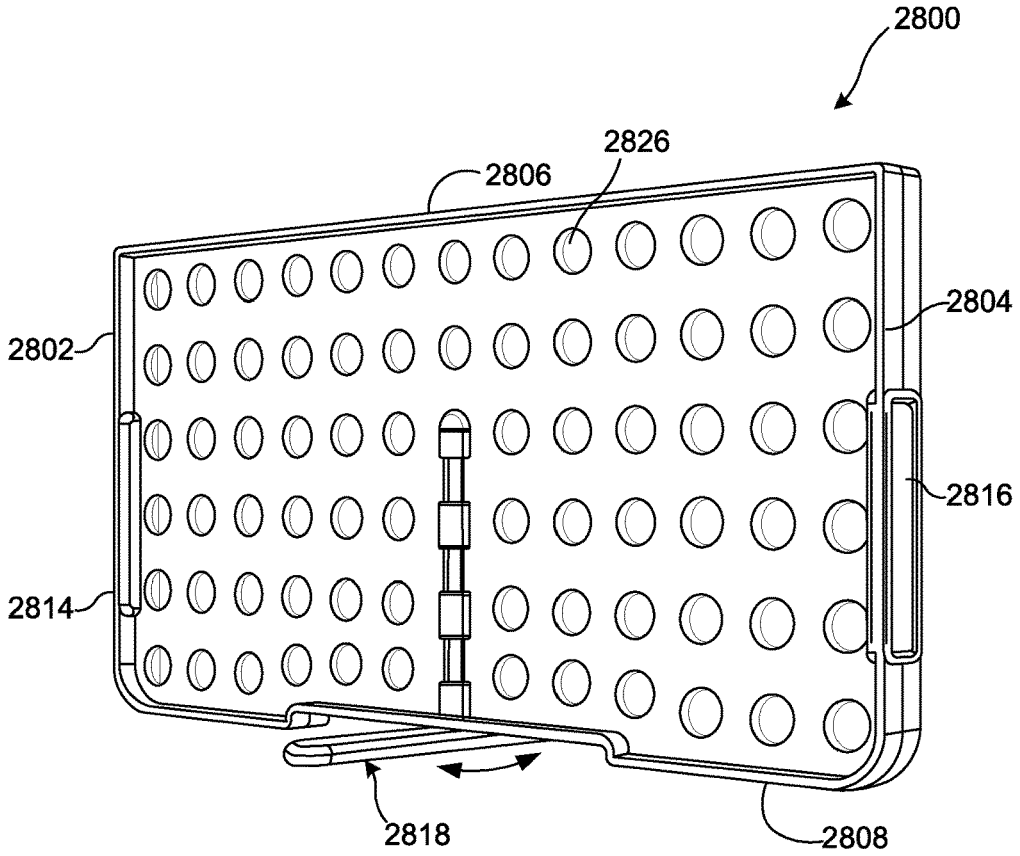
FIG. 29 illustrates a perspective view of the net module of FIG. 28.
Figure 30:
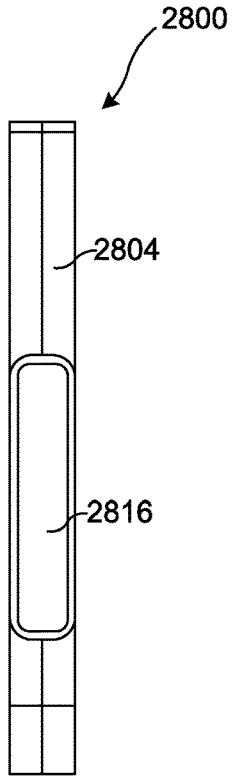
FIG. 30 illustrates a right-side view of the net module of FIG. 28.

FIG. 28, FIG. 29, FIG. 30 illustrate an exploded view, a perspective, and a right-side view, respectively, of a net module 2800, in accordance with some alternate embodiments of the net module of the present disclosure.

The net module 2800 may include a left-side edge 2802 and a right-side edge 2804 oppositely disposed to the left-side edge. The left-side edge 2802 and the right-side edge 2804 may define a net-module width therebetween. The net module 2800 may further include a top edge 2806 and a bottom edge 2808 oppositely disposed to the top edge 2806. The net module 2800 may further include a first-type coupler 2814 adjoining the left-side edge 2802 and a second-type coupler 2816 adjoining the right-side edge 2804. The second-type coupler 2816 may be configured different from the first-type coupler 2814. Further, the first-type coupler 2814 may be configured to engage with the second-type coupler 2816.

As shown in FIGS. 28-30, at least one of the first-type coupler 2814 and the second-type coupler 2816 may be a magnetic coupler. In particular, the first-type coupler 2814 may include a first magnet 2814 (the terms first-type coupler 2814 and first magnet 2814 may have been used interchangeably in this disclosure). The first magnet 2814 may include a first polarity side and a second polarity side (the second polarity side being attractable to the first polarity side). The first magnet 2814 may be adjoining the left-side edge 2802 of the net-module 2800, with one of the first polarity side and the second polarity side exposed from the left-side edge 2802 of the net-module 2800. For example, the first polarity side (e.g. positive polarity) may be exposed from the left-side edge 2802 of the net-module 2800. In some embodiments, the left-side edge 2802 of the net-module 2800 may include a slot 2810 for accommodating the first magnet 2814 therewithin. As such, the first magnet 2814 may be fitted in the slot 2810 and may be removable therefrom. Further, it should be noted that a depth of the slot 2810 may be slightly lesser than a depth (width) of the first magnet 2814, so as to cause the first magnet 2814 to slightly protrude outside the left-side edge 2802 so as to enable the first magnet 2814 to contact and couple with a second magnet of another net module.

The second-type coupler 2816 may be configured to be magnetically attracted to the first magnet 2814. To this end, the second-type coupler 2816 may include either an iron section or a second magnet. For example, as shown in FIGS. 28-30, the second-type coupler 2816 may be the second magnet 2816 (the terms second-type coupler 2816 and second magnet 2816 may have been used interchangeably in this disclosure). Further, the second magnet 2816 may be a similar magnet as the first magnet 2814, and therefore including a first polarity side and a second polarity side. The second magnet 2816 may be adjoining the right-side edge 2804 of each of the net-module 2800, with other of the first polarity side and the second polarity side exposed from the right-side edge 2804 of the net-module 2800. For example, the second polarity side (e.g. negative polarity) may be exposed from the right-side edge 2804 of the net-module 2800. Further, the right-side edge 2804 of the net-module 2800 may include a slot 2812 for accommodating the second magnet 2816 therewithin. As such, the second magnet 2816 may be fitted in the slot 2812 and may be removable therefrom. A depth of the slot 2812 may be slightly lesser than a depth (width) of the second magnet 2816, so as to cause the second magnet 2816 to slightly protrude outside the right-side edge 2804 so as to enable the second magnet 2816 to contact and couple with the first magnet of another net module.

Therefore, when two net modules 2800 are positioned adjacent to each other with the left-side edge 2802 of one of the two net modules 2800 adjacent the right-side edge 2804 of the other of the two net modules 2800, the first magnet 2814 and the second magnet 2816, owing to the opposite polarity, may attract each other. As such, the two net modules 2800 are coupled to each other. Similarly, when the second-type coupler 2816 is configured as an iron segment (instead of a magnet), the first magnet 2814 may cause the iron section to be attracted thereto, thereby coupling the two net modules 2800.

As such, in the play configuration of the collapsible net, the first magnet 2814 may be adjoining the left-side edge 2802 of each of the plurality of net-modules 2800, with one of the first polarity side and the second polarity side exposed from the left-side edge 2802 of each of the plurality of net-modules 2800. Further, the second magnet 2816 may be adjoining the right-side edge 2804 of each of the plurality of net-modules 2800, with the other of the first polarity side and the second polarity side exposed from the right-side edge 2804 of each of the plurality of net-modules 2800. Coupling of the net modules 2800 is illustrated in and explained via FIGS. 31-33.

Figure 31:
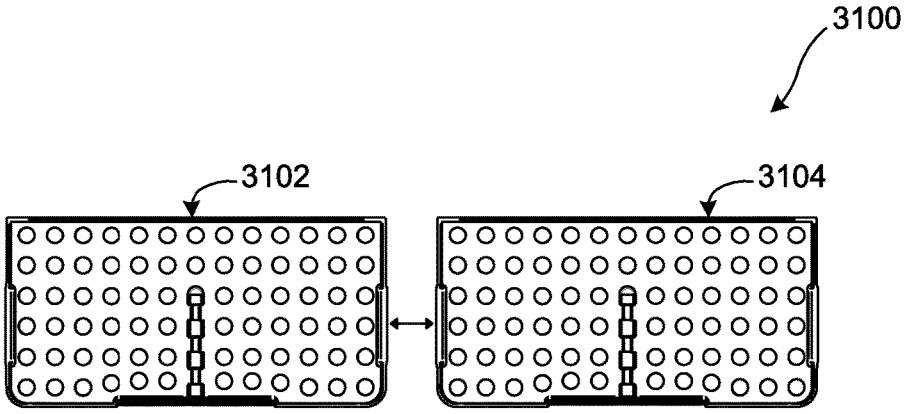
FIG. 31 illustrates a scenario relating to a collapsible net with a first net module and a second net module positioned separated from each other.
Figure 32:
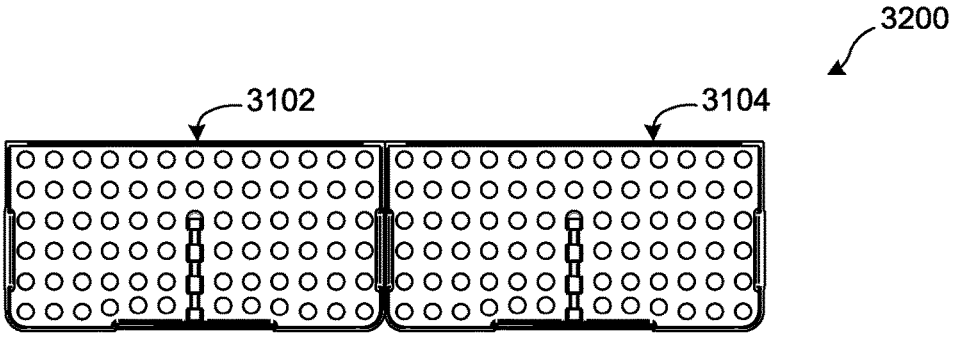
FIG. 32 illustrates another scenario of the portion of the collapsible net of FIG. 31 showing the first net module and the second net module coupled with each other.

FIG. 31 illustrates a scenario 3100 relating to a collapsible net with a first net module 3102 and a second net module 3104 (corresponding to the net module 2800) positioned separated from each other, in accordance with some embodiments. FIG. 32 illustrates a scenario 3200 of the portion of the collapsible net showing the first net module 3102 and the second net module 3104 coupled with each other, in accordance with some embodiments. The right-side edge of the first net module 3102 is facing the left-side edge of the second net module 3104. Considering that the first-type coupler adjoining the right-side edge first net module 3102 is the first magnet (2814) and the second-type coupler adjoining the left-side edge of the second net module 3104 is the second magnet (2816) or an iron section, the first-type coupler may attract the second-type coupler, thereby coupling the first net module 3102 and the second net module 3104, as shown in FIG. 32.

As such, in the play configuration, the right-side edge of the first net-module 3102 may be coupled with the left-side edge of the second net-module 3104, via the magnetic force of attraction between: the first polarity side or the second polarity side of the first magnet and the second polarity side or first second polarity side of the second magnet, respectively; or the first polarity side or the second polarity side of the first magnet and the iron section of the second magnet.

Figure 33:
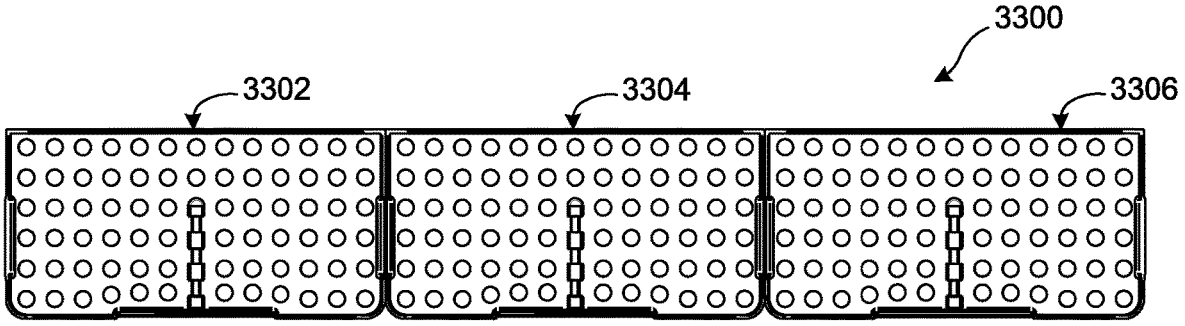
FIG. 33 illustrates another scenario with three net modules—a first net module, a second net module, and a third net module coupled with each other.
Figure 34:
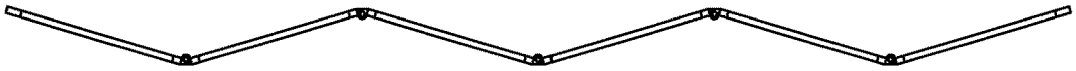
FIGS. 34-40 illustrate views (i.e., a top view, a front view, a left view, a right view, a bottom view, a rear view, and a perspective view, respectively) of one configuration of an ornamental design of a collapsible net.
Figure 35:
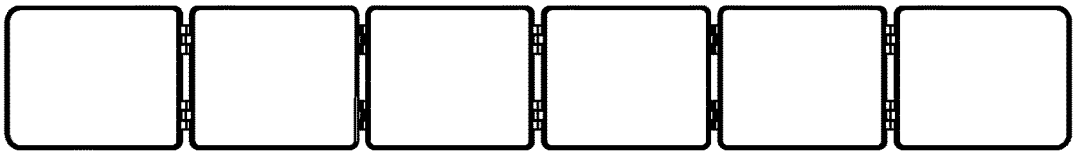
Figure 36:
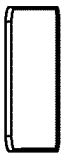
Figure 37:
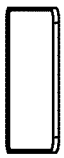
Figure 38:
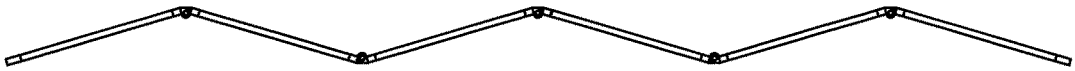
Figure 39:
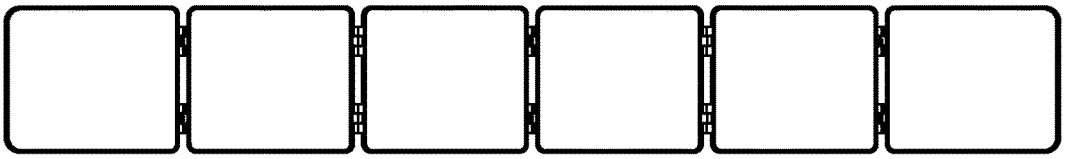
Figure 40:
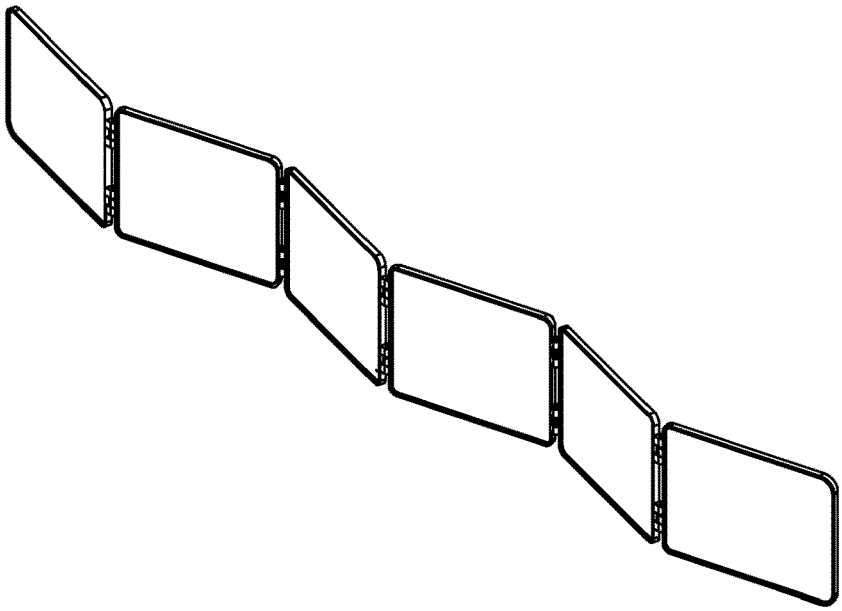
Figure 41:
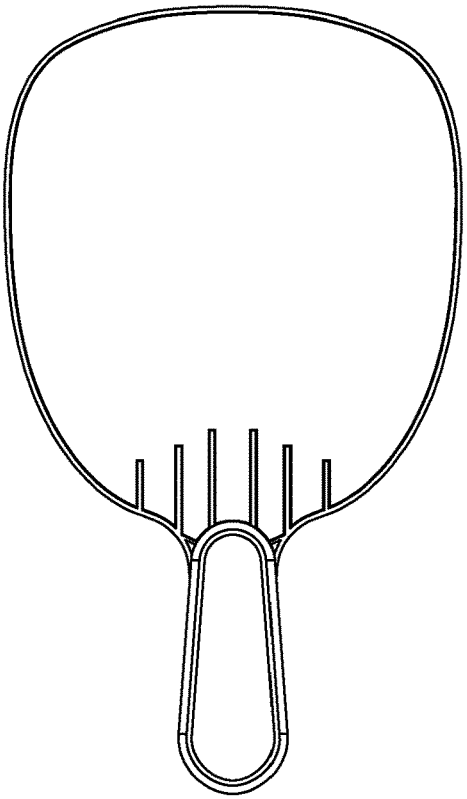
FIGS. 41-47 illustrate views (i.e., a front view, a rear view, a perspective view, a top view, a bottom view, a left side view, and a right side view, respectively) of one configuration of an ornamental design of a paddle.
Figure 42:
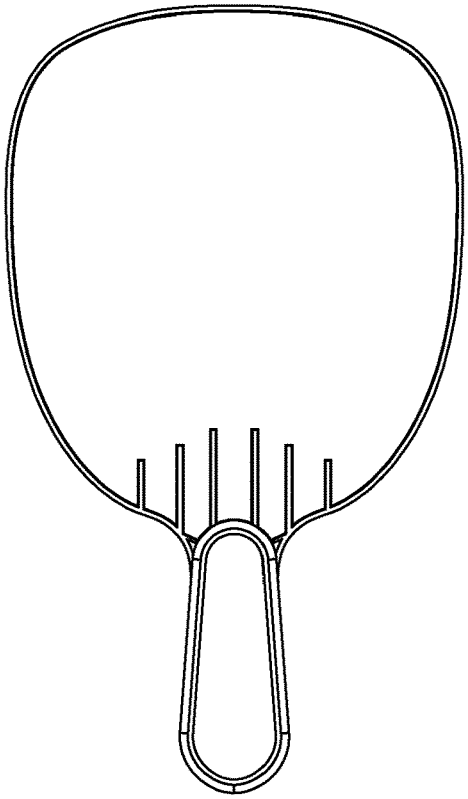
Figure 43:
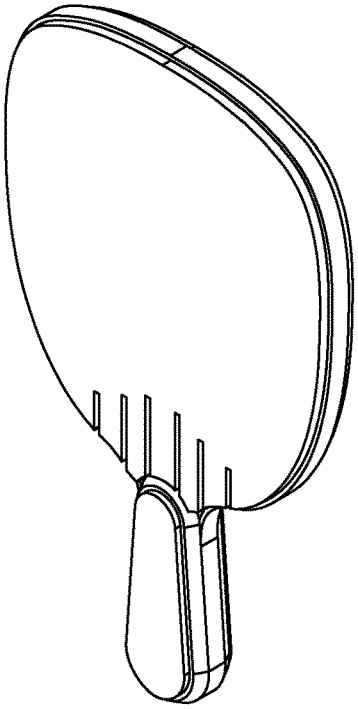
Figure 44:
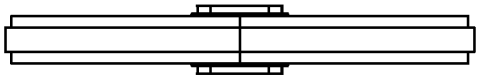
Figure 45:
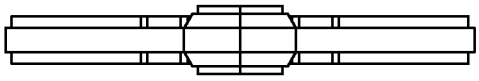
Figure 46:
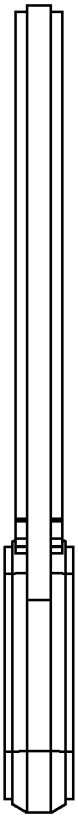
Figure 47:
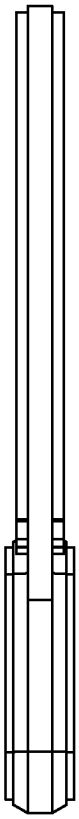
Figure 48:
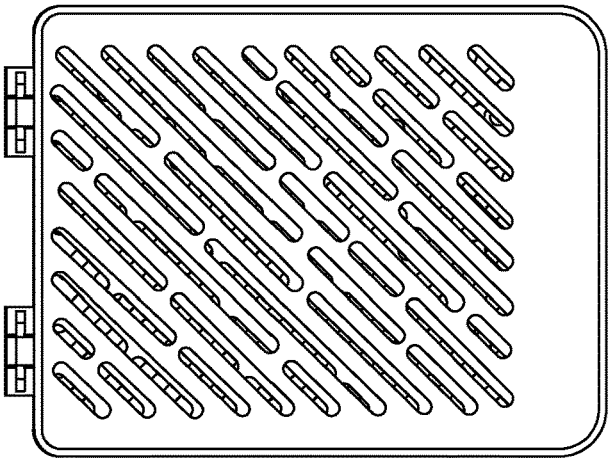
FIGS. 48-54 illustrate views (i.e., a front view, a rear view, a perspective view, a top view, a bottom view, a left side view, and a right side view) of one configuration of an ornamental design of the collapsible net in the stowed configuration.
Figure 49:
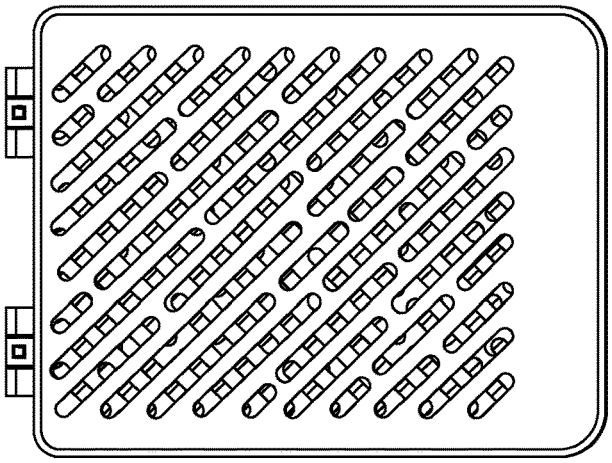
Figure 50:
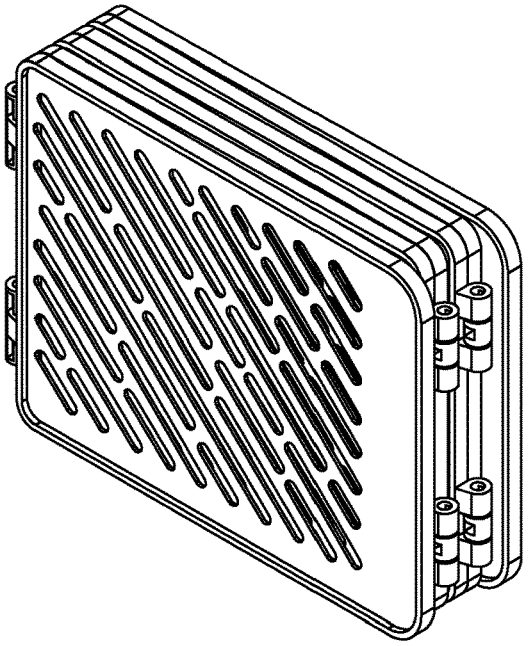
Figure 51:
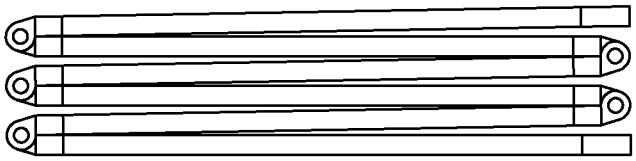
Figure 52:
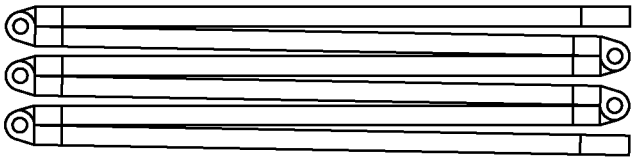
Figure 53:
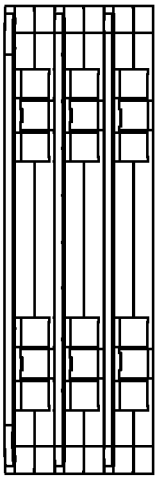
Figure 54:
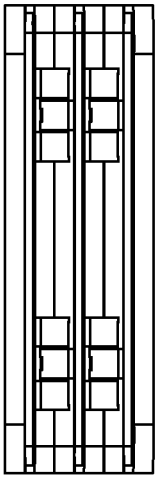
Figure 55:
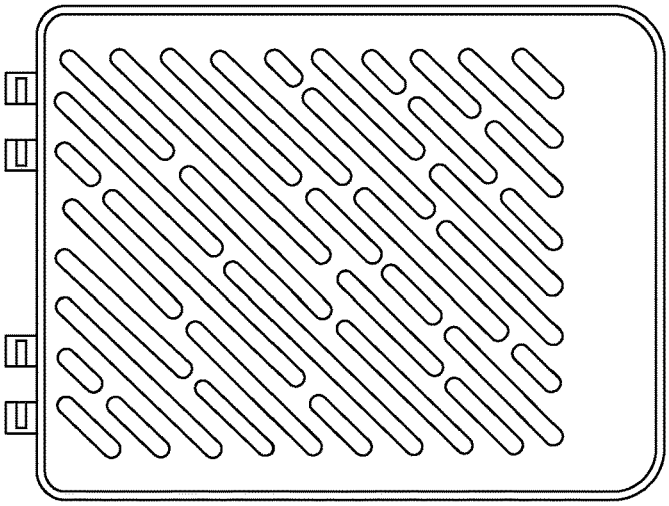
FIGS. 55-61 illustrate views (i.e., a front view, a rear view, a perspective view, a top view, a bottom view, a left side view, and a right side view) of one configuration of an ornamental design of the single-coupler receptacle-based net-module.
Figure 56:
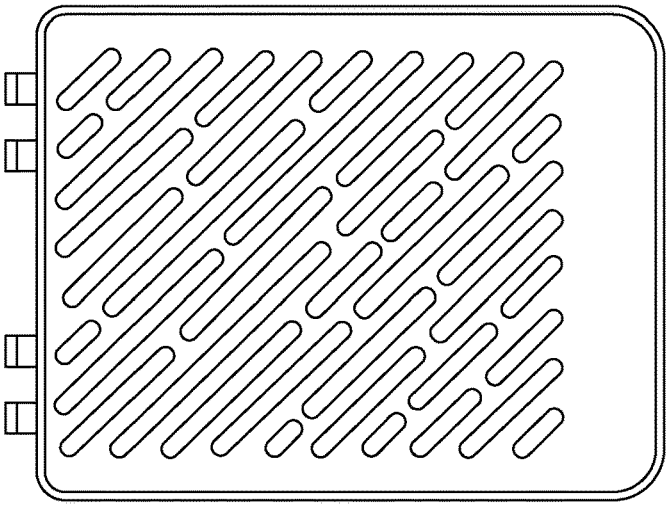
Figure 57:
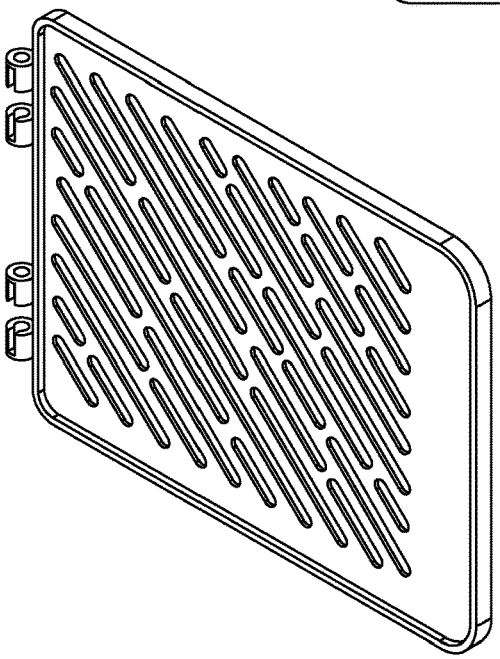
Figure 58:
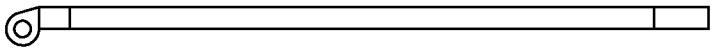
Figure 59:
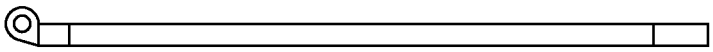
Figure 60:
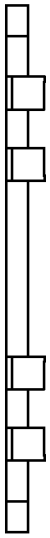
Figure 61:
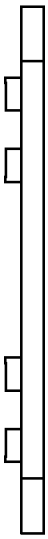
Figure 62:
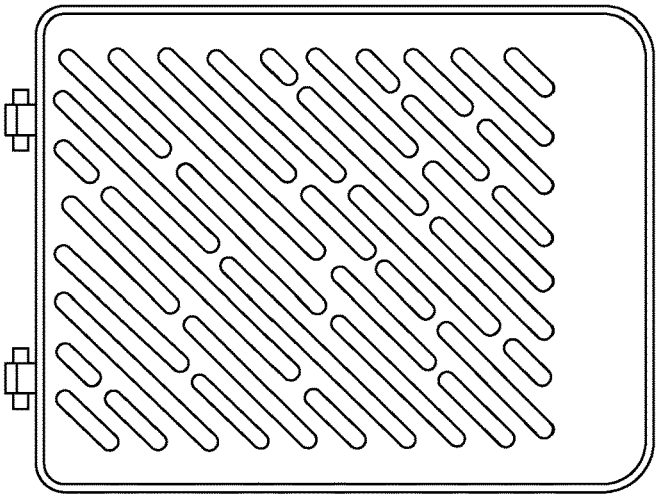
FIGS. 62-68 illustrate views (i.e., a front view, a rear view, a perspective view, a top view, a bottom view, a left side view, and a right side view) of one configuration of an ornamental design of the single-coupler protrusion-based net-module, in accordance with an illustrative configuration of the present disclosure.
Figure 63:
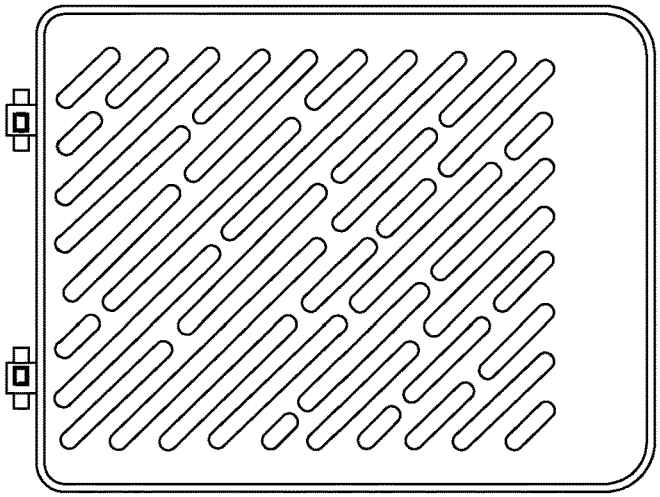
Figure 64:
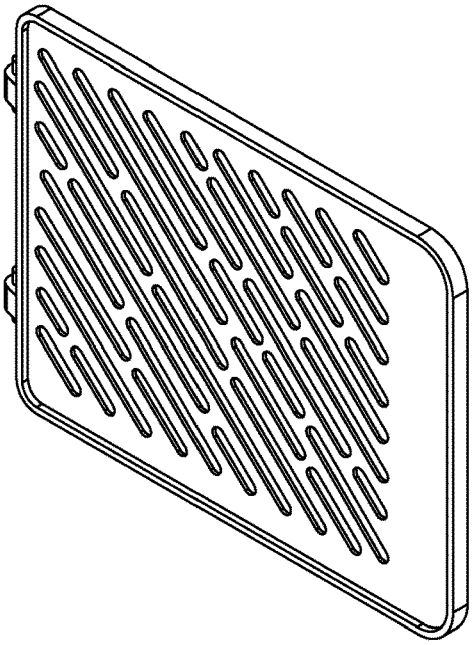
Figure 65:
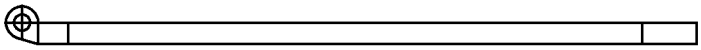
Figure 66:
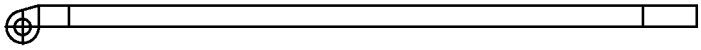
Figure 67:
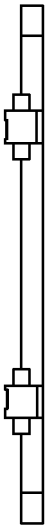
Figure 68:
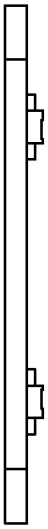
Figure 69:
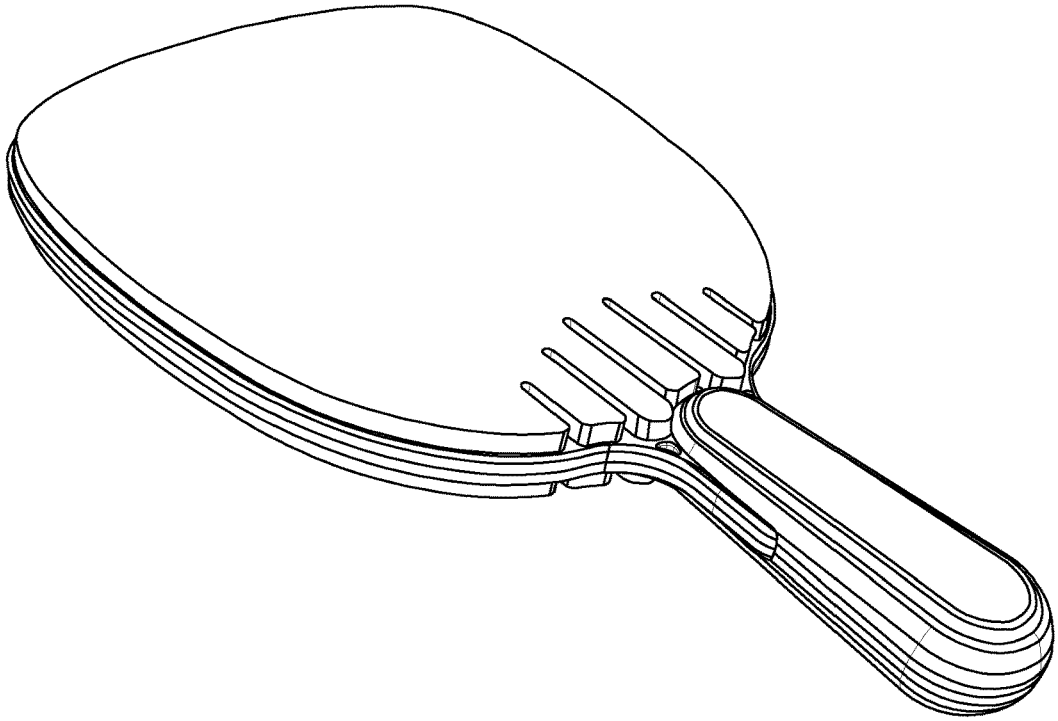
FIGS. 69-76 illustrate views (i.e., a front view, a rear view, a perspective view, a top view, a bottom view, a left side view, and a right side view, respectively) of one configuration of an ornamental design of a paddle.
Figure 70:
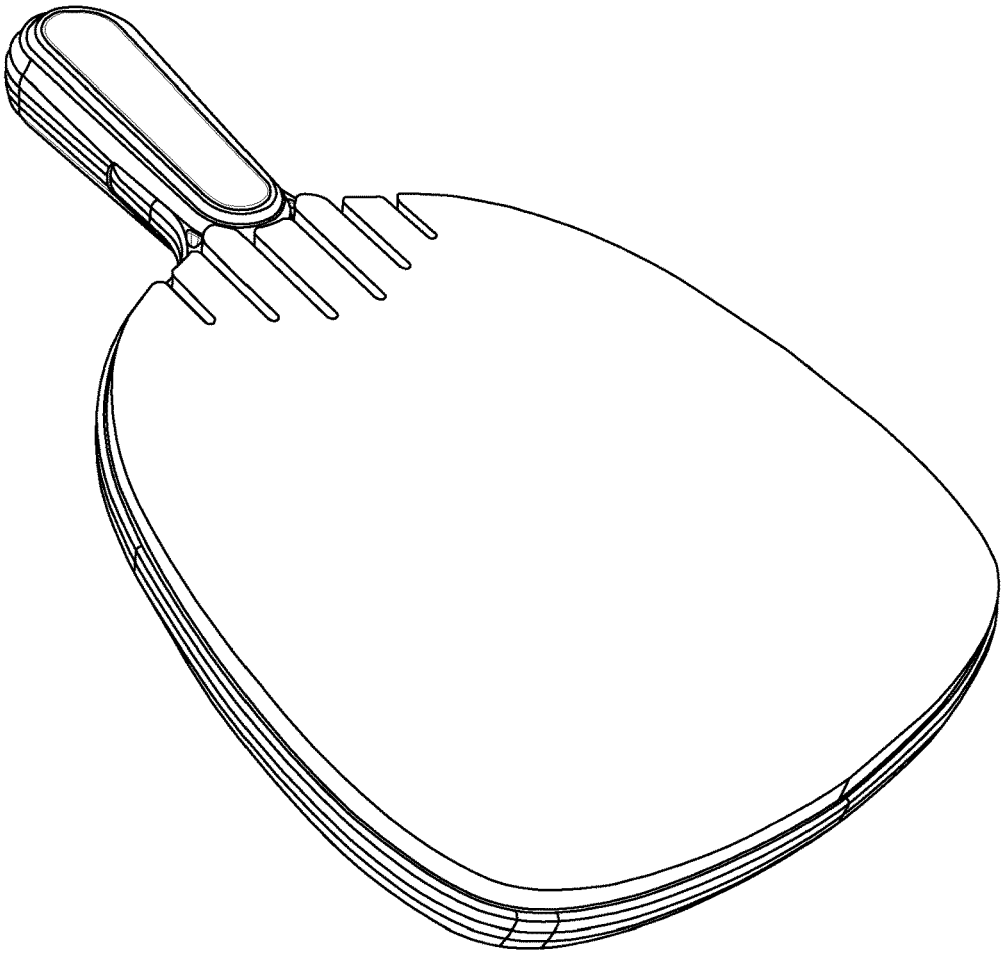
Figure 71:
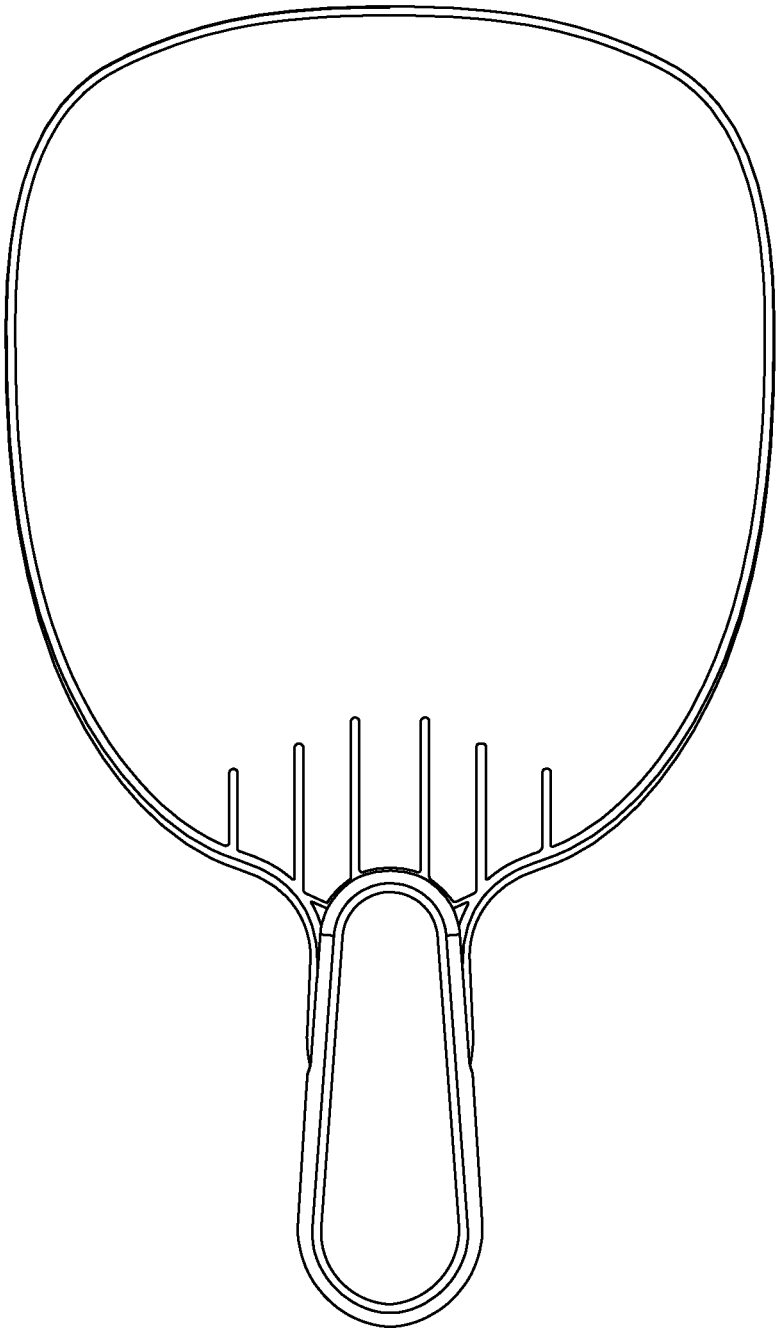
Figure 72:
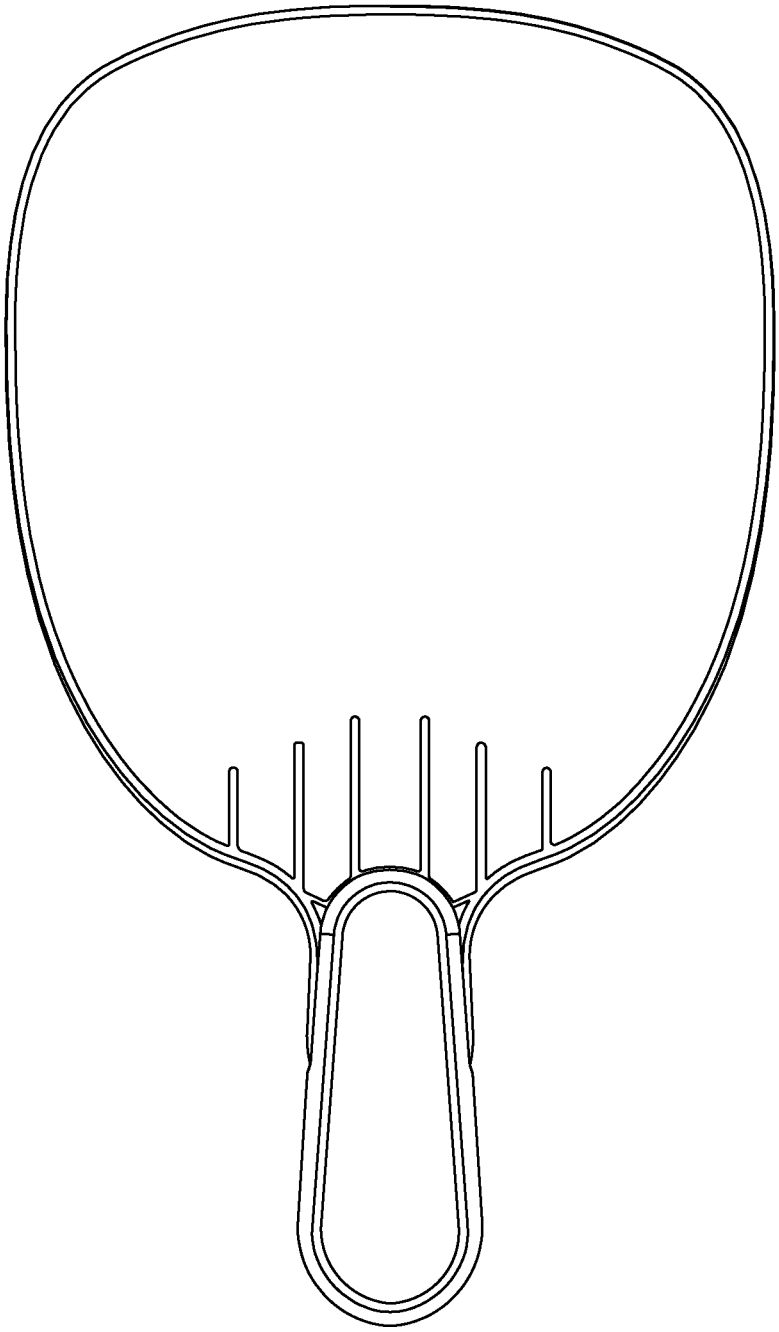
Figure 73:
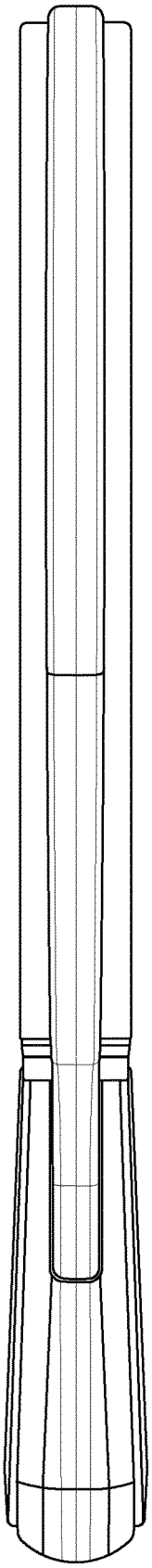
Figure 74:
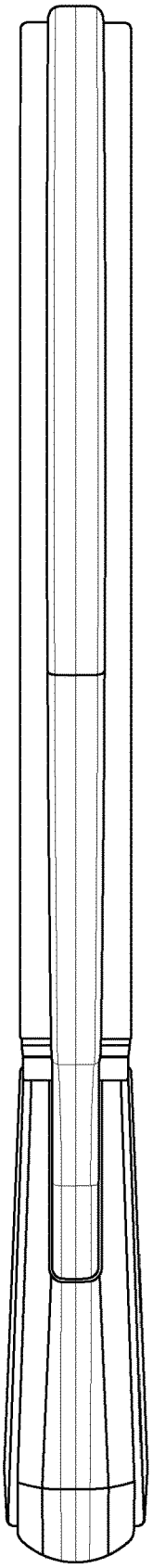
Figure 75:
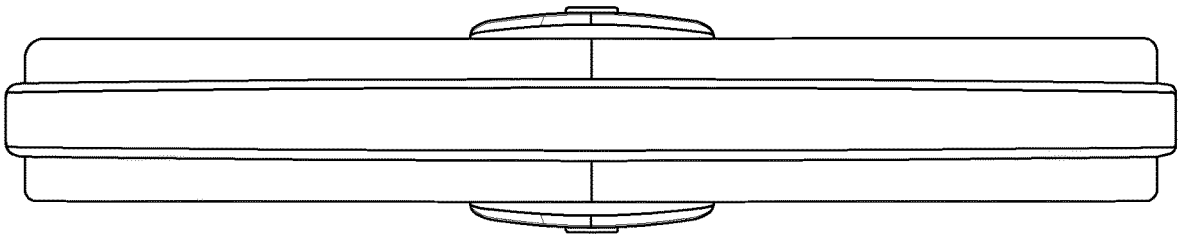
Figure 76:
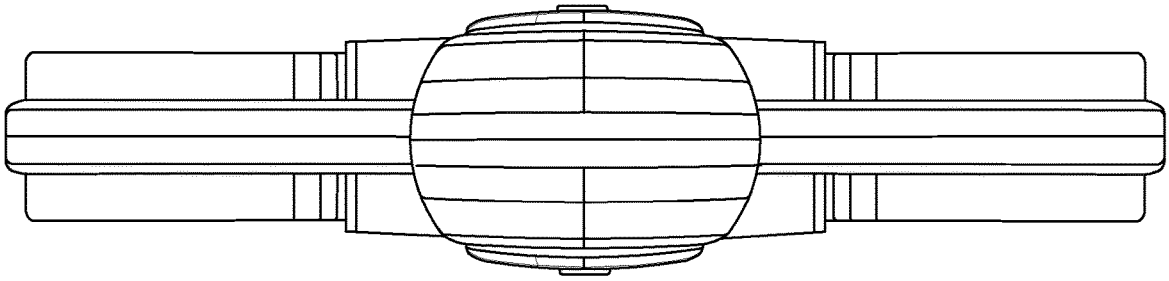

Similarly, FIG. 33 illustrates another scenario 3300 with three net modules—a first net module 3302, a second net module 3304, and a third net module 3306 (corresponding to the net module 2800) coupled with each other, in accordance with some embodiments. As such, the right-side edge of the first net module 3302 is facing the left-side edge of the second net module 3304, and the right-side edge of the second net module 3304 is facing the left-side edge of the third net module 3306. The three net modules are therefore coupled with each other due to the magnetic force of attraction between the respective first-type couplers and the second-type couplers.

A combined length of the net-modules 3302, 3304, 3306 is equal to a number of net-modules times the net-module width. It should be noted that an expanded length of the collapsible net formed using the net-modules 3302, 3304, 3306 is the combined length of the plurality of net-modules, i.e. number of net-modules times the net-module width. This is because the net-modules 3302, 3304, 3306 are placed adjacent to each other in a linear fashion (unlike the zig-zag fashion of the collapsible net 500). As such, in order to support the net modules 3302, 3304, 3306 to be erected on the surface, the net modules 3302, 3304, 3306 may include the collapsible stand, as described below.

Referring once again to FIGS. 28-29, the net module 2800 may further include a collapsible stand 2818, for erecting the net module 2800 and therefore, the collapsible net, during the play condition. The collapsible stand 2818 may include a foot 2820 and a stem 2822 attached to the foot 2820. The foot 2820 and the stem 2822 may be made from a metal or an alloy (e.g. Stainless Steel) that ensures long life and durability. Moreover, the heavy metal or alloy material of the foot 2820 and the stem 2822 adds to the stability. The foot 2820, for example, may include be an elongated member having a flat bottom. The stem 2822, for example, may be an elongated member oriented perpendicular to the foot 2820. The collapsible stand 2818 may be rotatably coupled with the net-module 2800, via the stem 2822. To this end, the net-module 2800 may include a vertical guide 2824 extending along the height of the net-module 2800. In some embodiments, the net module 2800 may include one vertical guide 2824 and therefore one collapsible stand 2818. In such embodiments, as shown in FIG. 28, the vertical guide 2824 may positioned in the middle of the width of the net module 2800. Alternately, the net module 2800 may include two vertical guides 2824 and therefore two collapsible stands 2818 positioned towards the left-side edge 2802 and the right-side edge 2804, respectively. The stem 2822 may have circular cross-section, to allow the stem 2822 to be rotatable within the vertical guide 2824.

The collapsible stand 2818 may be configurable between an open configuration (as shown in FIG. 29) and a closed configuration. In the open configuration, the foot 2820 may be oriented perpendicular to a plane defined by the net-module 2800. The perpendicular orientation provides support to net module 2800 to enable to be erected over a surface and impart stability sufficient to withstand windy outdoors. In the closed configuration, the foot 2820 may be oriented parallel to the plane defined by the net-module 2800. In order to configure the collapsible stand 2818 in the closed configuration, the foot 2820 may be rotated to orient the foot parallel to the plane of the net-module 2800.

In some embodiments, the net-module 2800 may further include a groove 2826 formed on the bottom edge 2808 of the net-module 2800. In the closed configuration, the foot 2820 may be oriented to be positioned within the groove 2826. This allows for the easy and compact packing of the net module 2800, when not in use (i.e. the stowed configuration of the collapsible net).

Referring now to FIGS. 34-40, views (i.e., a top view, a front view, a left view, a right view, a bottom view, a rear view, and a perspective view, respectively) of an ornamental design of a collapsible net (corresponding to the collapsible net 500) are illustrated, in accordance with an illustrative configuration of the present disclosure.

Referring now to FIGS. 41-47, views (i.e., a front view, a rear view, a perspective view, a top view, a bottom view, a left side view, and a right side view, respectively) of an ornamental design of a paddle (corresponding to the paddle 102) are illustrated, in accordance with an illustrative configuration of the present disclosure.

Referring now to FIGS. 48-54, views (i.e., a front view, a rear view, a perspective view, a top view, a bottom view, a left side view, and a right side view) of an ornamental design of the collapsible net 105 in the stowed configuration are illustrated, in accordance with an illustrative configuration of the present disclosure.

Referring now to FIGS. 55-61, views (i.e., a front view, a rear view, a perspective view, a top view, a bottom view, a left side view, and a right side view) of an ornamental design of the single-coupler receptacle-based net-module 1600 are illustrated, in accordance with an illustrative configuration of the present disclosure.

Referring now to FIGS. 62-68, views (i.e., a front view, a rear view, a perspective view, a top view, a bottom view, a left side view, and a right side view) of an ornamental design of the single-coupler protrusion-based net-module 1100 are illustrated, in accordance with an illustrative configuration of the present disclosure.

Specific details are given in the above description to provide a thorough understanding of the configurations. However, it is understood that the configurations may be practiced without these specific details. For example, circuits may be shown in block diagrams in order not to obscure the configurations in unnecessary detail. In other instances, well-known circuits, processes, algorithms, structures, and techniques may be shown without unnecessary detail in order to avoid obscuring the configurations.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

While illustrative and presently preferred configurations of the disclosed systems, methods, and/or machine-readable media have been described in detail herein, it is to be understood that the inventive concepts may be otherwise variously embodied and employed, and that the appended claims are intended to be construed to include such variations, except as limited by the prior art. While the principles of the disclosure have been described above in connection with specific apparatuses and methods, it is to be clearly understood that this description is made only by way of example and not as limitation on the scope of the disclosure.

What is claimed is:

1. A collapsible net for a game play, the collapsible net comprising:

a plurality of net-modules, each of the plurality of net-modules comprising:

an I-shaped cross-section profile; a left-side edge;

a right-side edge oppositely disposed to the left-side edge, and defining a net-module width between the right-side edge and the left-side edge;

a top edge perpendicularly disposed to the left-side edge and the right-side edge;

a bottom edge oppositely disposed to the top edge;

a first-type coupler adjoining the left-side edge of each of the plurality of net-modules; and a second-type coupler adjoining the right-side edge of each of the plurality of net-modules, the second-type coupler configured different from the first-type coupler;

wherein the first-type coupler is configured to engage with the second-type coupler;

wherein the plurality of net-modules are configurable between a play configuration and a stowed configuration, wherein:

the play configuration comprises:

a first net-module of the plurality of net-modules;

a second net-module of the plurality of net-modules; and a zig-zag arrangement;

wherein the right-side edge of the first net-module is coupled to the left-side edge of the second net-module via the first-type coupler engaging with the second-type coupler in the zig-zag arrangement to define an expanded length of the collapsible net, wherein the expanded length is less than a number of the net modules times a net module width; and the stowed configuration comprises:

the right-side edge of the first net-module is adjacent to the left-side edge of the second net-module, and the left-side edge of the first net-module is adjacent to the right-side edge of the second net-module.

2. The collapsible net of claim 1, and further comprising:

wherein the first-type coupler comprises:

at least one first-type hinge; and wherein the second-type coupler comprises:

at least one second-type hinge configured to rotate relative to the at least one first-type hinge.

3. The collapsible net of claim 1, and further comprising:

wherein the first-type coupler comprises:

a pin protrusion adjoining at least a portion of the left-side edge of each of the plurality of net-modules;

wherein the second-type coupler comprises:

a receptacle adjoining at least a portion of the right-side edge of each of the plurality of net-modules; and wherein the receptacle is configured to rotatably engage the pin protrusion, to thereby couple the left-side edge of the first net-module with the right-side edge of the second net-module.

4. The collapsible net of claim 1, wherein each of the plurality of net-modules comprises:

a rigid panel; and a rectangular profile.

5. The collapsible net of claim 4, wherein each of the plurality of net-modules comprises:

a plurality of openings formed in the rectangular profile.

6. The collapsible net of claim 5, wherein the plurality of openings are formed diagonally in the rectangular profile.

7. The collapsible net of claim 1, wherein each of the plurality of net-modules comprises:

a collapsible stand comprising:

a foot; and a stem attached to the foot;

wherein the collapsible stand is rotatably coupled with each of the plurality of net-modules, via the stem;

wherein the collapsible stand is configurable between an open configuration and a closed configuration, wherein in the open configuration, the foot is oriented perpendicular to a plane defined by each of the plurality of net-modules; and wherein in the closed configuration, the foot is oriented parallel to the plane defined by each of the plurality of net-modules.

8. The collapsible net of claim 7, wherein each of the plurality of net-modules further comprises:

a groove formed on the bottom edge;

wherein in the closed configuration, the foot is oriented positioned within the groove.

9. The collapsible net of claim 1 and further comprising:

a first single-coupler protrusion-based net-module attached to a first end of the at least one of the plurality of net modules.

10. The collapsible net of claim 9 and further comprising:

a second single-coupler protrusion-based net-module attached to at least one of the plurality of net modules oppositely disposed to the first single-coupler protrusion-based net-module.

11. The collapsible net of claim 10, wherein the first single-coupler protrusion-based net-module and the second single-coupler protrusion-based net-module further comprises:

an extended portion.

12. A collapsible net for a game play, the collapsible net comprising:

a plurality of net-modules, each of the plurality of net-modules comprising:

an I-shaped cross-section profile; a left-side edge;

a right-side edge oppositely disposed to the left-side edge;

a top edge; and a bottom edge oppositely disposed to the left-side edge;

a first-type coupler adjoining the left-side edge of each of the plurality of net-modules;

a second-type coupler adjoining the right-side edge of each of the plurality of net-modules, and a zig-zag arrangement;

wherein the second-type coupler is engaged with the first-type coupler;

wherein net-modules of each pair of net-modules of the plurality of net-modules are rotatably coupled with each other, via the first-type coupler and the second-type coupler;

a play configuration, wherein in the play configuration, each of the plurality of net-modules is positioned away from an adjacent net-module in the zig-zag arrangement to define an expanded length of the collapsible net, wherein the expanded length is less than a number of the net modules times a net module width; and a stowed configuration, wherein in the stowed configuration, each of the plurality of net-modules is positioned facing an adjacent net-module, to thereby define a collapsed length of the collapsible net, wherein the plurality of net-modules are configurable between the play configuration and the stowed configuration.

13. The collapsible net of claim 12, wherein the first-type coupler comprises:

at least one first-type hinge;

wherein the second-type coupler comprises:

at least one second-type hinge:

wherein the at least one first-type hinge is engaged with the at least one second-type hinge, and wherein the at least one first-type hinge is vertically offset from the at least one second-type hinge.

14. The collapsible net of claim 12, wherein each of the plurality of net-modules comprises:

a frame defining a periphery comprising:

the left-side edge;

the right-side edge oppositely disposed to the left-side edge;

the top edge; and the bottom edge oppositely disposed to the top edge; and a mesh adjoining at least two of the left-side edge, the right-side edge, the top edge, and the bottom edge, within the periphery defined by the frame.

15. The collapsible net of claim 12, wherein each of the plurality of net-modules comprises:

a collapsible stand comprising:

a foot; and a stem attached to the foot;

wherein the collapsible stand is rotatably coupled with each of the plurality of net-modules, via the stem;

wherein the collapsible stand is configurable between an open configuration and a closed configuration, wherein in the open configuration, the foot is oriented perpendicular to a plane defined by each of the plurality of net-modules; and wherein in the closed configuration, the foot is oriented parallel to the plane defined by each of the plurality of net-modules.

16. The collapsible net of claim 15, wherein each of the plurality of net-modules further comprises:

a groove formed on the bottom edge;

wherein in the closed configuration, the foot is adjacent to the groove.

17. A collapsible net for a game play, the collapsible net comprising:

a plurality of protrusion-based net-modules, each of the plurality of protrusion-based net-modules comprising:

an I-shaped cross-section profile; a left-side edge;

a right-side edge oppositely disposed to the left-side edge, and defining a net-module width between the right-side edge and the left-side edge;

a top edge;

a bottom edge oppositely disposed to the top edge;

a first-type coupler adjoining at least one of the left-side edge and the right-side edge of each of the plurality of protrusion-based net-modules;

wherein the first-type coupler comprises:

a pin protrusion adjoining at least a portion of the left-side edge of each of the plurality of protrusion-based net-modules;

a plurality of receptacle-based net-modules, each of the plurality of receptacle-based net-modules comprising:
a left-side edge;
a right-side edge oppositely disposed to the left-side edge, and defining a net-module width between the right-side edge and the left-side edge;
a top edge;
a bottom edge oppositely disposed to the top edge;
a second-type coupler adjoining at least one of the left-side edge and the right-side edge of each of the plurality of receptacle-based net-modules;
wherein the second-type coupler comprises:
a receptacle adjoining at least a portion of each of the left-side edge and the right-side edge of each of the plurality of receptacle-based net-modules; and
wherein the receptacle is configured to rotatably engage the pin protrusion, to thereby couple a receptacle-based net-module with a protrusion-based net-module; and
a zig-zag arrangement;
wherein the plurality of receptacle-based net-modules and the plurality of protrusion-based net-modules are configurable between a play configuration and a stowed configuration;
wherein in the play configuration, each of the plurality of receptacle-based net-modules and the plurality of protrusion-based net-modules is positioned away from an adjacent net-module in a zig-zag arrangement to define an expanded length of the collapsible net, wherein the expanded length is less than a number of the net modules times a net module width; and
wherein in the stowed configuration, each of the plurality of receptacle-based net-modules and the plurality of protrusion-based net-modules is positioned facing an adjacent net-module, to thereby define a collapsed length of the collapsible net.

18. The collapsible net of claim 17,
wherein the first-type coupler adjoining the left-side edge is facing opposite to the first-type coupler adjoining the right-side edge of each of the plurality of protrusion-based net-modules; and
wherein the second-type coupler adjoining the left-side edge is facing opposite to the second-type coupler adjoining the right-side edge of each of the plurality of receptacle-based net-modules.

19. A game apparatus comprising:
at least a pair of paddles;
a first ball comprising:
a first predefined hardness;
a second ball comprising:
a second predefined hardness different from the first predefined hardness; and
a collapsible net configured to free-stand on a surface, the collapsible net comprising:
a plurality of net-modules, each of the plurality of net-modules comprising:
an I-shaped cross-section profile; a left-side edge;
a right-side edge oppositely disposed to the left-side edge;
a top edge; and
a bottom edge oppositely disposed to the top edge; and
a first-type coupler adjoining the left-side edge of each of the plurality of net-modules; and
a second-type coupler adjoining the right-side edge of each of the plurality of net-modules,
wherein the second-type coupler is couplable with the first-type coupler;
wherein each of the plurality of net-modules is configured to couple with another of the plurality of net-modules, via one of the first-type coupler and the second-type coupler; and
a zig-zag arrangement;
wherein the plurality of net-modules are configurable between a play configuration and a stowed configuration;
wherein in the play configuration, each of the plurality of net-modules is positioned away from an adjacent net-module in a zig-zag arrangement to define an expanded length of the collapsible net, wherein the expanded length is less than a number of the net modules times a net module width; and
wherein in the stowed configuration, each of the plurality of net-modules is positioned facing an adjacent net-module, to thereby collapsed length of the collapsible net.

20. The game apparatus of claim 19, wherein each of the pair of paddles comprises:
a flat panel comprising:
a top surface; and
a bottom surface;
a first elastic panel attached to the top surface
a second elastic panel attached to the bottom surface; and
a handle attached to the flat panel.

21. The game apparatus of claim 20, wherein the first elastic panel comprises:
a plurality of cut-outs adjoining the handle, the plurality of cut-outs configured to enable a grip.

* * * * *